US012492566B2

(12) United States Patent
Ginestet et al.

(10) Patent No.: US 12,492,566 B2
(45) **Date of Patent: *Dec. 9, 2025**

(54) CHAMBER ASSEMBLY FOR GENERATING WAVES

(71) Applicant: WHITEWATER WEST INDUSTRIES LTD, Richmond (CA)

(72) Inventors: Clement Ginestet, Saint-Quen (FR); Alexander Wynne-Edwards, Victoria (CA); Nicholas Dortmans, Vancouver (CA); Axel Terradillos, Vancouver (CA)

(73) Assignee: WHITEWATER WEST INDUSTRIES LTD, Richmond (CA)

( * ) Notice: Subject to any disclaimer, the term of this patent is extended or adjusted under 35 U.S.C. 154(b) by 0 days.

This patent is subject to a terminal disclaimer.

(21) Appl. No.: 19/044,850

(22) Filed: Feb. 4, 2025

(65) Prior Publication Data

US 2025/0179823 A1 Jun. 5, 2025

Related U.S. Application Data

(63) Continuation of application No. 18/540,722, filed on Dec. 14, 2023, now Pat. No. 12,247,413, which is a continuation of application No. 17/652,680, filed on Feb. 25, 2022, now Pat. No. 11,891,834.

(60) Provisional application No. 63/153,923, filed on Feb. 25, 2021.

(51) Int. Cl.
*E04H 4/00* (2006.01)

(52) U.S. Cl.
CPC ..... *E04H 4/0006* (2013.01)

(58) Field of Classification Search
CPC ..... E04H 4/006
USPC ..... 4/491, 488, 541.1, 904
See application file for complete search history.

(56) References Cited

U.S. PATENT DOCUMENTS 4,515,500 A * 5/1985 Bastenhof ..... E04H 4/0006 4/491
4,558,474 A * 12/1985 Bastenhof ..... E04H 4/0006 4/491
4,999,860 A * 3/1991 Chutter ..... E04H 4/0006 4/491

(Continued)

FOREIGN PATENT DOCUMENTS

CA 2825739 A1 * 5/2014 ..... A63G 31/007
CA 3179309 A1 * 11/2021 ..... A63B 69/0093

(Continued)

OTHER PUBLICATIONS

First Office Action for Chinese Application No. 2024117058770, dated Apr. 23, 2025, 15 pages.

(Continued)

*Primary Examiner* — Lori L Baker
(74) *Attorney, Agent, or Firm* — Buchalter, a Professional Corporation

(57) ABSTRACT

A chamber assembly for generating waves includes a chamber for releasing water to generate a wave, the chamber comprising a sensor and an ingress valve; and a control system connected to the sensor and the ingress valve, wherein the control system receives input from the sensor to enable the control system to selectively control the position of the ingress valve to thereby permit air into the chamber to effect the release of water from the chamber.

20 Claims, 29 Drawing Sheets

(56) References Cited

U.S. PATENT DOCUMENTS

| | | | | |
|---|---|---|---|---|
| 5,833,393 | A | 11/1998 | Carnahan et al. | |
| 8,434,966 | B1 * | 5/2013 | McFarland | A63G 31/007 4/491 |
| 9,103,133 | B2 * | 8/2015 | McFarland | A63G 31/007 |
| 9,279,263 | B2 * | 3/2016 | McFarland | E04H 4/0006 |
| 10,145,135 | B2 | 12/2018 | McFarland et al. | |
| 10,280,640 | B2 | 5/2019 | McFarland et al. | |
| 10,526,806 | B2 * | 1/2020 | McFarland | A63B 69/125 |
| 10,738,492 | B1 | 8/2020 | McFarland | |
| 11,891,834 | B2 * | 2/2024 | Ginestet | E04H 4/0006 |
| 12,098,569 | B2 | 9/2024 | Ginestet et al. | |
| 12,247,413 | B2 | 3/2025 | Ginestet et al. | |
| 2010/0000014 | A1 * | 1/2010 | Lochtefeld | E04H 4/0006 4/491 |
| 2010/0158611 | A1 | 6/2010 | Demarteau | |
| 2012/0255112 | A1 * | 10/2012 | Osterman | E04H 4/0006 4/491 |
| 2013/0227777 | A1 * | 9/2013 | McFarland | E04H 4/0006 4/491 |
| 2014/0115770 | A1 * | 5/2014 | McFarland | A63G 31/007 4/491 |
| 2015/0330093 | A1 * | 11/2015 | McFarland | G06F 3/04817 4/491 |
| 2019/0032350 | A1 * | 1/2019 | McFarland | G06F 3/04817 |
| 2019/0194963 | A1 * | 6/2019 | McFarland | A63G 31/007 |
| 2020/0181929 | A1 * | 6/2020 | McFarland | G06F 3/0486 |
| 2022/0203250 | A1 * | 6/2022 | McFarland | E04H 4/0006 |
| 2022/0282508 | A1 * | 9/2022 | Dawson | E04H 4/0006 |
| 2022/0290455 | A1 | 9/2022 | Ginestet et al. | |
| 2023/0166195 | A1 | 6/2023 | McFarland et al. | |
| 2024/0133198 | A1 | 4/2024 | Ginestet et al. | |
| 2024/0183179 | A1 | 6/2024 | Ginestet et al. | |
| 2024/0247510 | A1 | 7/2024 | Ginestet et al. | |

FOREIGN PATENT DOCUMENTS

| | | | | |
|---|---|---|---|---|
| CA | 2825739 | C | 3/2023 | |
| JP | H05231395 | A | 9/1993 | |
| WO | WO-02086257 | A1 * | 10/2002 | E04H 4/0006 |
| WO | WO-2021159200 | A1 * | 8/2021 | E04H 4/0006 |
| WO | 2021232138 | A1 | 11/2021 | |
| WO | WO-2022178622 | A1 * | 9/2022 | E04H 4/0006 |
| WO | WO-2023082027 | A1 * | 5/2023 | A63G 31/007 |
| WO | 2024082059 | A1 | 4/2024 | |

OTHER PUBLICATIONS

Corrected Notice of Allowance for U.S. Appl. No. 18/540,722, dated Feb. 12, 2025, 4 pages.
Ex Parte Quayle Action for U.S. Appl. No. 18/604,296, dated Jun. 10, 2024, 15 pages.
International Search Report and Written Opinion for International Application No. PCT/CA2022/000005, dated Jun. 8, 2022, 08 pages.
Non-Final Office Action for U.S. Appl. No. 17/652,680, dated Jun. 8, 2023, 10 pages.
Non-Final Office Action for U.S. Appl. No. 18/540,722, dated Jul. 9, 2024, 10 Pages.
Notice of Allowance for U.S. Appl. No. 17/652,680, dated Oct. 26, 2023, 10 pages.
Notice of Allowance for U.S. Appl. No. 18/540,722, dated Dec. 30, 2024, 9 pages.
Notice of Allowance for U.S. Appl. No. 18/604,296, dated Jul. 26, 2024, 6 pages.
Office Action for Saudi Arabia Application No. 523450375, dated Jun. 11, 2024, 12 pages.
Supplementary European Search Report for European Application No. 22758654.2, mailed Dec. 18, 2024, 09 Pages.

* cited by examiner

CHAMBER ASSEMBLY FOR GENERATING WAVES

CROSS-REFERENCE TO RELATED APPLICATIONS

This application is a continuation of U.S. patent application Ser. No. 18/540,722, filed Dec. 14, 2023, which is a continuation of U.S. patent application Ser. No. 17/652,680, filed Feb. 25, 2022 and issued as U.S. Pat. No. 11,891,834 on Feb. 6, 2024, which claims the benefit of U.S. Provisional Patent Application Ser. No. 63/153,923, filed on Feb. 25, 2021, the contents of each of which are incorporated herein by reference in their entirety.

BACKGROUND

Water attractions have brought fun to different people from different geographic locations for many generations. The water attraction permits different geographic areas to have access to simulated experiences from other geographic areas. For example, a wave pool may approximate an experience at a beach.

Different water attractions may be used to approximate natural environments to permit users to experience sports and activities from these other environments. For example, sheet wave rides simulate a surfing or boogie boarding experience that permits a rider, with their body or a thin board, to ride upon a sheet flow of water that is contoured by an underlying ride surface. The sheet wave ride does not provide a true surfing experience, as the sheet flow does not permit wave breaking or the use of an actual surfboard.

Deep wave surfing systems are provided that attempt to create a more accurate approximation of the surfing experience in the natural environment. U.S. Pat. Nos. 8,434,966; 9,103,133; 9,279,263; 10,145,135; 10,280,640; and 10,526,806 disclose deep wave surfing simulators, each of which is incorporated by reference in their entirety herein.

Deep wave rides pose a unique challenge to manage the vast amount of water that is used in the ride. For example, currents and eddy currents may form that can undermine the wave formation. Managing the air and the water into and out of the chambers is also problematic. Air in the chamber can act like a spring and the momentum of the water leaving and returning to the chamber may create unwanted forces and oscillations and other movement on the water. These forces may, in turn, create unwanted wave effects, turbulence, and other adverse features within the generated wave.

SUMMARY

A pool wave generator is disclosed having a pool area and a plurality of chambers for generating a wave in the pool area. The plurality of chambers may be used to retain or release water into the pool to create a desired wave.

Exemplary embodiments described herein may include unique pool and chamber configurations for managing fluid flow, including the water and air within the chambers, to influence desired patterns of waves and control or minimize undesirable wave effects. Exemplary embodiments of the system and methods described herein may be used to control a variety of features of the wave, for example, the water height in the chamber, which may be used to dampen residual waves after a wave is generated in the pool. Such exemplary configurations may be useful in creating and maintaining desired wave formations and in permitting repeated wave formations either in a series along a length of a pool or in time a desired time interface, such as in the length of time between waves. Exemplary embodiments may also be used to control and define tailored waves that can have individual features that are controllable or programmable.

Also disclosed is a chamber assembly for generating waves, the chamber assembly comprising a chamber for releasing water to generate a wave, the chamber comprising a sensor and an ingress valve; and a control system connected to the sensor and the ingress valve, wherein the control system receives input from the sensor to enable the control system to selectively control the position of the ingress valve to thereby permit air into the chamber to effect the release of water from the chamber.

Although described herein in terms of a deep wave pool having specific characteristics, including the pool shape, chambers to release water, and troughs to control return of water into the pool, such embodiments are exemplary only. Exemplary embodiments of the chamber and control system and methods for generating a wave can be used in different water environments. For example, embodiments described herein may be used to generate waves for surfing, or merely for a wave pool. Exemplary embodiments may be used for other aquatic rides in which water is retained and released in a controlled manner.

DETAILED DESCRIPTION

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Exemplary embodiments described herein include a pool configured to create waves. The pool may include one or more chambers at one or more ends that are configured to receive and release water into the pool for generating the waves. Exemplary chambers are provided to reduce turbulence, customize the time between waves, and generate better waves. The pool may be configured to generate different zones that define or generate waves of different profiles or for use by individuals of different experience levels. The pool may also be configured, either in the floor configuration or in the inclusion of additional water features such as lagoons and channels for controlling water flow to dissipate wave energy and control water currents.

Although various embodiments may be described and illustrated herein in terms of a pool wave generator having unique and novel features, it should be understood that embodiments of the pool wave generator do not require or necessitate the inclusion of each of the features. The instant disclosure does not require any specific component, configuration, or feature, and any combination of features may be incorporated or combined and remain within the full description of the pool wave generator. For example, the inclusion of the elongated chamber between the chamber and the pool to reduce eddy currents may be used in any conventional features of a pool wave generator. Similarly, the inclusion of the spectator area, or the bottom contour to generate different wave zones may similarly be used alone or in conjunction with other features described herein.

Figure 1A:
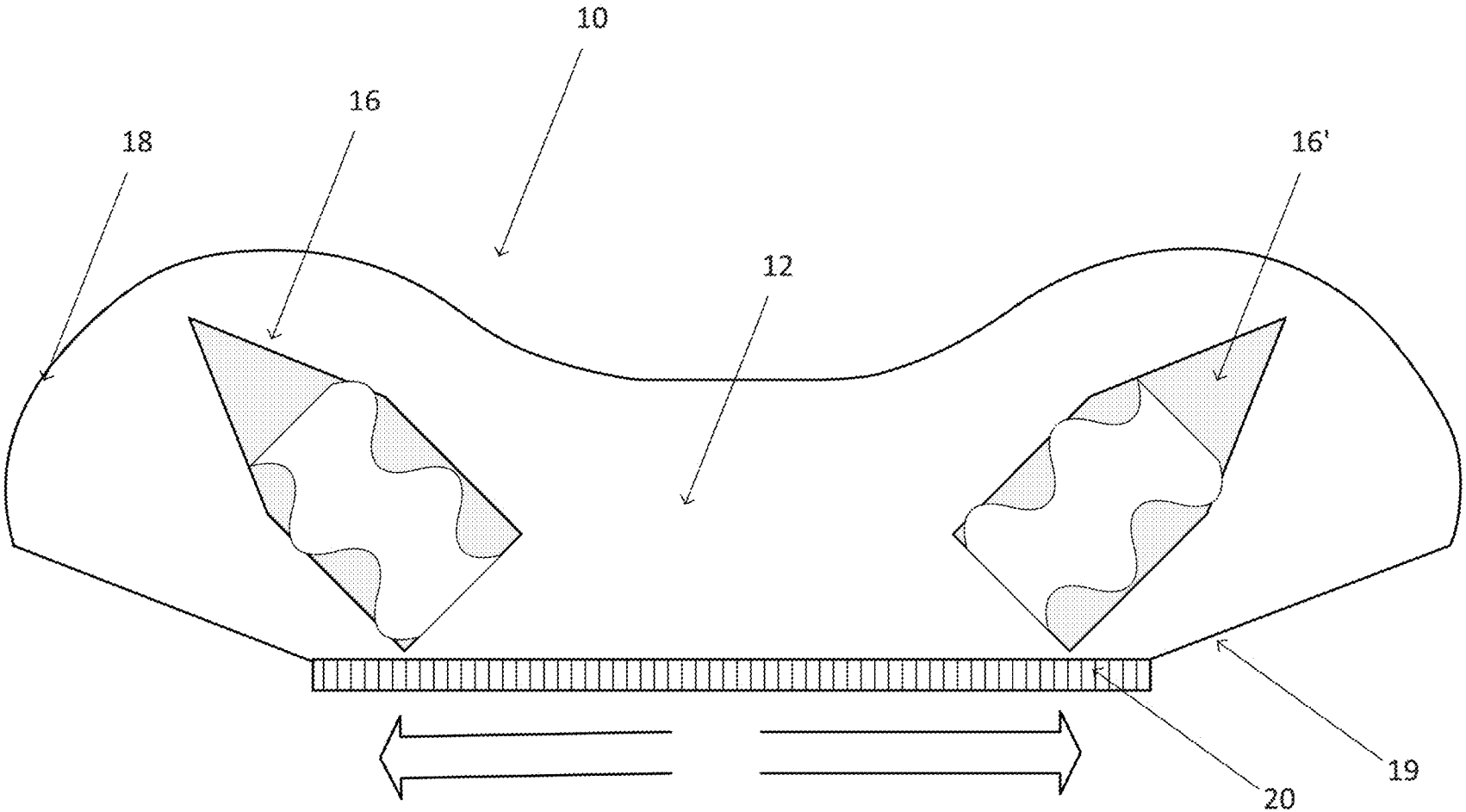
FIGS. 1A and 1B illustrate a top-down view of exemplary pool wave generators according to embodiments of the disclosure.

FIG. 1A illustrates an exemplary wave pool according to embodiments of the disclosure. The exemplary pool wave generator 10 may include a pool area 12 and one or more chambers 20 for generating a wave within the pool area 12. The wave 16 may propagate away from the chamber(s) 20 and toward a terminal end 18 of the pool.

In an exemplary embodiment, the pool area 12 may be a recessed pool configured to hold water. The terminal end 18 may be a wall for retaining the water. The wall may be vertical or may be sloped. In an exemplary embodiment, the terminal end is created by a sloped bottom of the pool to approximate or resemble a beach area. As the water is pushed across the pool area 12 by the release of water from the chambers 20, the water may travel toward the terminal end 18 and travel across and up the sloped bottom until the water stops and eventually comes back to the pool area along the sloped bottom under the influence of gravity.

Figure 1B:
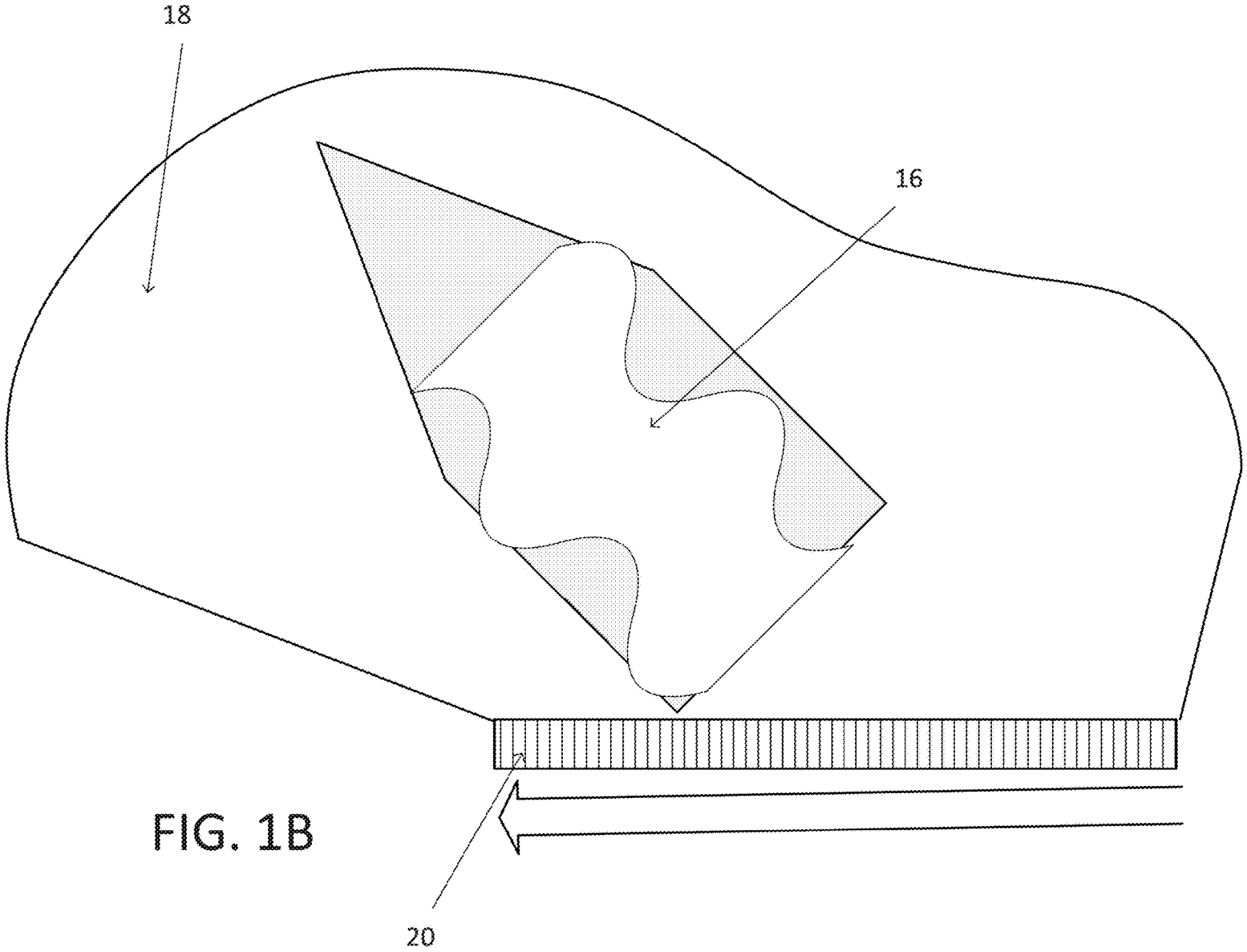

FIG. 1A illustrates an exemplary pool wave generator that comprises two sides in which a first wave 16 and a second wave 16' may be propagated from the chambers toward opposite ends of the pool area 12. The view in FIG. 1A is depicted as viewed from above looking down at a pool area. The pool wave generator 10 of this embodiment may be used to create different areas in the pool area 12 that may have similar or different wave profiles for use by different riders. The different areas in the pool area 12 may be used to create waves 16, 16' for riders or participants having levels of experience. Exemplary embodiments include a pool wave generator in which a wave is propagated in a single direction, such as illustrated in FIG. 1B.

As represented by the arrows adjacent the chambers 20, the chambers 20 may release water into the pool area 12 to create waves moving toward different ends of the pool. The chambers 20 may be linearly aligned along one side of the pool. The chambers 20 may also include different directions, configurations, and orientations. The release of water from the chambers 20 may be used to control wave attributes, such as a wave height, direction, shape, time interval between the start of wave propagation, etc. As illustrated, chambers located toward the middle of the plurality of chambers 20 may in this or other embodiments be released simultaneously together and then subsequent chambers may release in sequence together or individually, moving outward toward opposing ends of the plurality of chambers. The chambers 20 may also be configured to release in different directions, patterns, or sequence, such as from one end to the other or from opposing ends toward the middle of the plurality of chambers 20.

FIG. 1A illustrates an exemplary embodiment in which a linear arrangement of chambers 20 is provided along one edge of the pool area 12. The chambers 20 may traverse along a portion or an entire length of the edge of the pool area 12. As illustrated, projecting immediately from the end of the last chamber on the edge of the pool area 12, a lateral side of the pool wall 19 may extend at a non-zero angle measured from the linear extension of the edge of the pool defined by the plurality of chambers 20. In other words, the lateral pool wall 19 may immediately extend forward from the end of the chamber. The lateral wall may also have a component that extends outward in a continued extension of the chamber linear direction, thus forming a non-zero, non-perpendicular angle with the linear extension of the pool edge comprising the plurality of chambers 20. Angling the pool wall 19 may reduce the amount of water required to fill a pool 12 and reduce those areas of the pool 12 that may produce less desirable wave action.

Figure 2A:
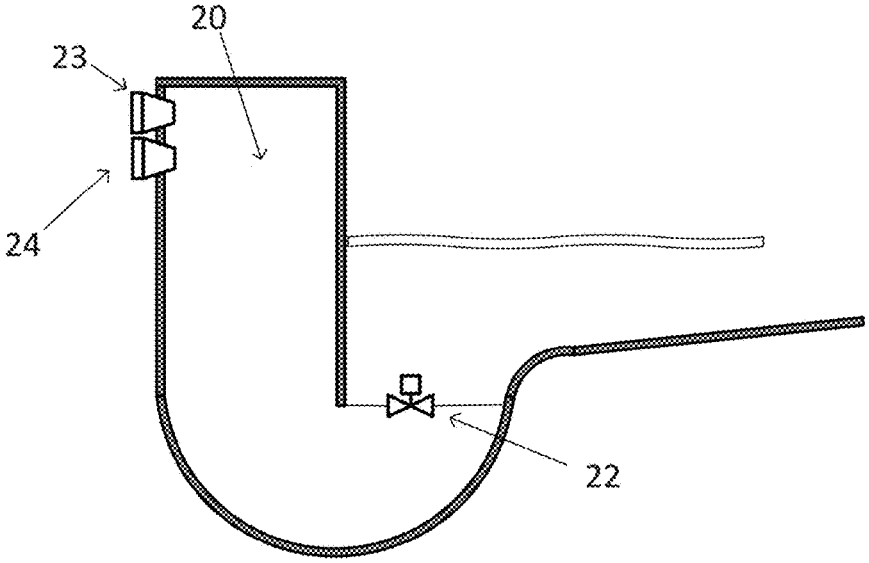
FIGS. 2A, 2B, and 2C illustrate an exemplary wave generating chamber and associated control thereof to generate a wave in the dep wave pool described herein.
Figure 2B:
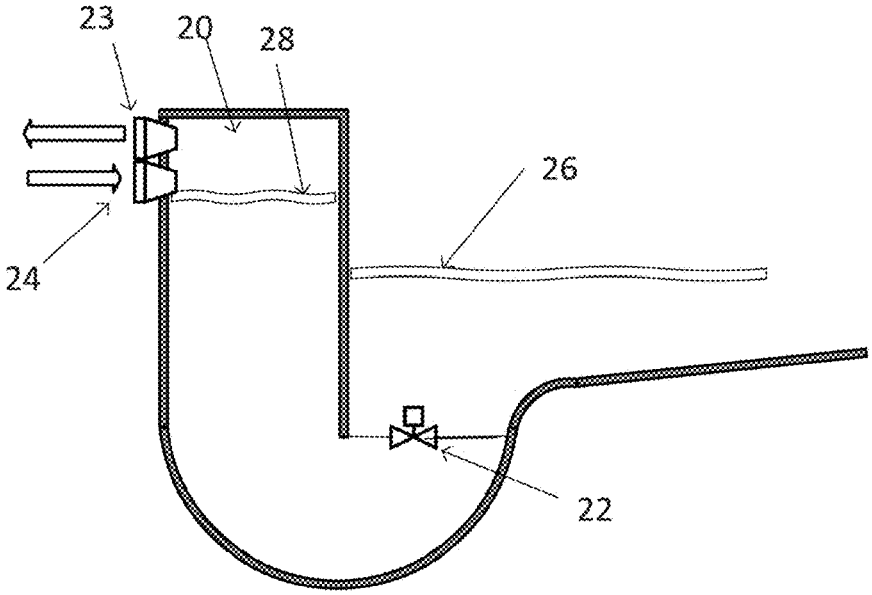
Figure 2C:
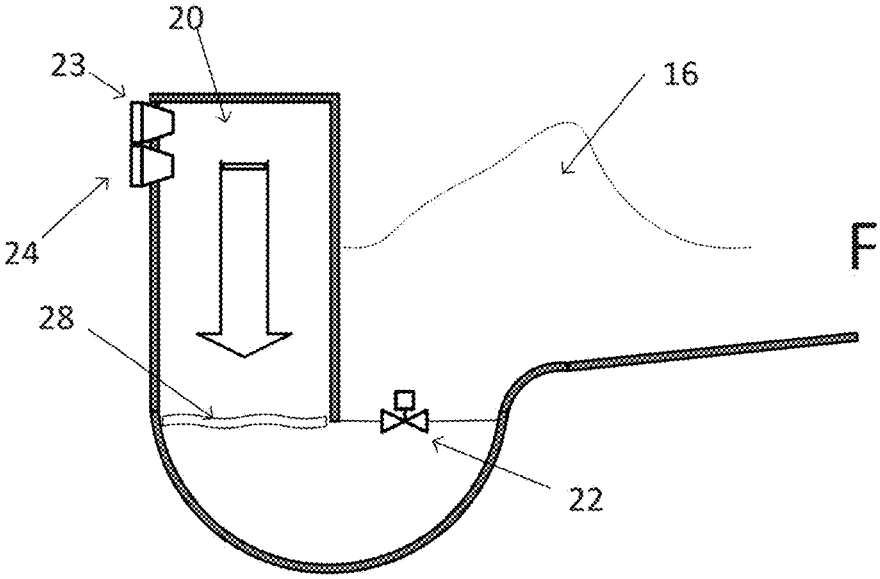

FIGS. 2A-2C illustrate an exemplary wave generating chamber 20 of the plurality of chambers in FIG. 1 and associated control thereof to generate a wave in the wave pool described herein. The chamber 20 may be configured to retain water at a chamber water level 28. As shown in FIGS.

2B-2C, when water is released into the pool the chamber water level 28 changes from a first level shown in FIG. 2B to a second level shown in FIG. 2C below the first level in FIG. 2B. As a result of the change of chamber water level 28, a pool water level 26 rises from first pool water level 26 in FIG. 2B thereby creating a wave 16 in FIG. 2C that propagates away from the chamber 20, across the pool area 12. The chamber 20 may include one or more valves 22, 23, 24 for controlling the retention and release of the water within the chamber 20. As discussed below, each of the valves 23, 24 in each chamber 20 can transition from fully open to fully closed or any intermediate position therebetween to thereby control the release of water into the pool and the rate at which the chamber water level 28 changes from the first level in FIG. 2B to the second level shown in FIG. 2C. In an exemplary embodiment, a first valve 22 may control the water flow into and out of the chamber 20. In an exemplary embodiment, a second valve or a plurality of valves 23, 24 may control air or fluid flow into and out of the chamber 20. A shown in FIGS. 2A-2C, an exemplary ingress valve 24 may be used to introduce pressurized gas into the chamber 20. An exemplary exhaust valve 23 may be used to remove gas from the chamber 20 by venting gas or applying negative pressure to the chamber.

In an exemplary embodiment, the wave generating system may include a control system. The control system may include a sensor within each chamber 20. The sensor may be comprised of one or more sensors. In an exemplary embodiment, the sensor may include a water height sensor, pressure sensor, or temperature sensor. In an exemplary embodiment, the water height sensor may be used to determine or approximate the water height within the chamber. In another embodiment, the pressure sensor may be used to determine or approximate the water height within the chamber 20. Other control sensors may be incorporated, such as within the plenum, at the vent, at the ingress valves or ingress valve actuator, at the pressure fans or at fan motors, or at the control panel controlling the fans motor. Any combination of the sensors may be configured as an input into the control system to assist in the operation or control of the chamber. In an exemplary embodiment, the control system is configured to receive an input from one or more sensors and control one or more valves 22, 23, 24 in response to the received sensor input.

In an exemplary embodiment, the control system may comprise actuators for setting a position of one or both of the egress valve 23 and the ingress valve 24 causing one or both valves to transition the valves from fully open to fully closed or any intermediate position therebetween. For example, if fully closed is considered zero degrees, and fully open is considered ninety degrees, the valve may be positioned at any angle from 0 to 90 degrees. In an exemplary embodiment, one or both of the ingress valve 24 and exhaust valve 23 are equipped with a position controller so that the one or more valves may be opened to a position anywhere from fully open to fully closed, and anywhere in between.

In an exemplary embodiment, the water height 28 in the chamber 20 may be measured with one or more sensors within the chamber 20. In an exemplary embodiment, a sensor is positioned at the top of the chamber 20. In an exemplary embodiment, the sensor is configured to provide an input into the control system so that the control system may determine a height of the water within the chamber 20. The control system may be configured to control one or both of the exhaust vent valve 23 or ingress valve 24 to control a desired water height within the chamber 20.

In an exemplary embodiment, the chamber 20 includes a pressure sensor. The control system may be configured to control one or both of the exhaust vent valves 23 and ingress valve 24 to maintain a desired pressure within the chamber. In an exemplary embodiment, the pressure sensor within the chamber may be in fluid communication with the chamber.

Exemplary embodiments described herein may include a control system that is able to set a position of one or more of exhaust valve 23 and ingress valve 24 to fully open and fully closed. The control system may be configured to control a corresponding wave height by controlling variable frequency drives (VFD) to achieve a desired pressure.

Exemplary embodiments described herein may include a control system that is able to set a position of one or more of exhaust valve 23 and ingress valve 24 from anywhere from fully open to fully closed, and any intermediate position there between. Exemplary embodiments comprise positioning one or more valves in an intermediate position between fully open and fully closed. The control system may be configured to control a corresponding wave height by height set points and not VFD frequency.

As seen in FIG. 2A, the system may have been released so that no water is in the chamber 20 or the water level 28 in the chamber 20 is at a low level (such as illustrated in FIG. 2C). The exhaust valve 23 may be opened to purge air from the chamber 20. The chamber 20 may be configured to evacuate air from the chamber 20, such that the chamber 20 is negatively pressurized. The ingress valve 24 may also be open, such that the chamber 20 is at neutral pressure and the air in the chamber is permitted to vent as the chamber is filled with water. The first valve 22 is opened and the rush of water into the chamber 20 elevates the water level in the chamber 20.

As seen in FIG. 2B, the first valve 22 is closed to retain the chamber water level 28 at a height greater than the pool water level 26. The chamber 20 may then be filled with a pressurized gas to impose additional pressure on the water within the chamber 20. The ingress valve 24 is then closed and the first valve 22 is then opened.

As seen in FIG. 2C, the pressurized air in the chamber 20 pushes the water level 28 within the chamber 20, which in turn surges water out of the chamber 20 to generate a wave 16 that propagates across the pool, as in FIG. 1. The first valve 22 may be closed while the air in the chamber 20 is vented, such as through the exhaust valve 23. The first valve 22 may be closed to limit the amount of water let back into the chamber 20 to minimize disruption to the formed wave 16. The first valve 22 may also remain open to permit the water to return to the chamber 20 and be closed as discussed with respect to FIG. 2B.

In an exemplary embodiment, the control system may be configured to control an ingress valve 24 for providing air into the chamber 20 and an exhaust valve 23 for removing air from the chamber 20. The system may also include one or more sensors used as an input into the control system for determining a height of the water within the chamber 20 or a pressure of the air within the chamber 20 or in a part of the system in fluid communication with the chamber 20. In an exemplary embodiment, the control system comprises a feedback loop such that the exhaust valve 23 and ingress valve 24 are opened to a position to control a water height within the chamber 20 and/or maintain a desired pressure within the chamber 20. The valve control operates to control the rate at which the chamber water level 28 changes which, in turn, impacts the corresponding pool water level rise 26, 16.

Exemplary embodiments may include a user interface in which the control system may be programmed. The user interface may be configured to display information to the user and may receive inputs from the user. The user interface may be used to provide settings for the control systems such as in determining a desired relationship between the valve position and the sensor inputs. In an exemplary embodiment, the user interface is configured to receive desired water height profile information describing a desired wave characteristic, such as water height profile in the chambers, from a user, in which the system thereafter is configured to determine control parameters in order to achieve the desired wave characteristic. Exemplary embodiments of the control system may therefore be used to control wave height during wave generation. Exemplary embodiments of the control system may be used to control wave shapes, wave characteristics, etc. The system may be used to create unique and fully tailored waves as each chamber 20 can be fully actuated without regard to actuation of any other chamber 20 to create a combined effect with the water to configure almost any wave. Thus, contrary to the prior art systems, the current embodiment allows actuation of the chambers together in unison, or in groups, or separately in any order to create the desired wave profile.

In an exemplary embodiment shown in FIGS. 2A-2C, the system is configured to cycle through the process of releasing water from each chamber 20 and permitting the resurgence of water into each chamber 20. The system may also include a delay after any number of cycles to permit the water in the pool to settle and reduce turbulence that could affect wave generation.

In the exemplary embodiment provided, three valves are illustrated-a first valve 22 for water control and a second (exhaust) and third (ingress) valves 23, 24 for gas control. Any combination of valves may be used and are within the scope of the instant disclosure. For example, multiple gas valves may be used to vent the chamber 20, inject pressurized gas, etc., and multiple fluid valves may be used to emit or retain the water within the chamber 20. The order and cycle of the valves as described herein is exemplary only. As described herein, the system may also operate without the first valve 22 for water control, instead relying on operation of the exhaust valve 23 and ingress valve 24 to maintain water height within each chamber 20. Any number of different ways may be used to release the wave using valves, gates, or other methods. The valves may be opened and closed in different ways. For example, the system may use a purge system to remove gas from the chamber before resurgence of water to elevate the water level returning to the chamber 20. For example, the system may not use a pressurized gas system for expelling the water into the pool. For example, single direction valves may be used such that valves do not necessitate individual actuation to open and close. The valves of each chamber may be controlled individually or as a sequence within a larger operation of the entire pool system. In other words, the valves within the chambers may be actuated individually in a serial manner, or in unison, or in groups.

Exemplary embodiments of the control system described herein may be used to control power consumption or to reduce the power consumption required to generate waves of the same size. The power consumption may be achieved as additional energy is not necessarily expended through dampening the residual waves created by the water oscillation within the chamber. Exemplary embodiments of the control system described herein may be used to control current generation (or reduction) within the pool. The exemplary embodiments described here may result in more efficient operation of the wave pool and also in better longevity of equipment.

Figure 3:
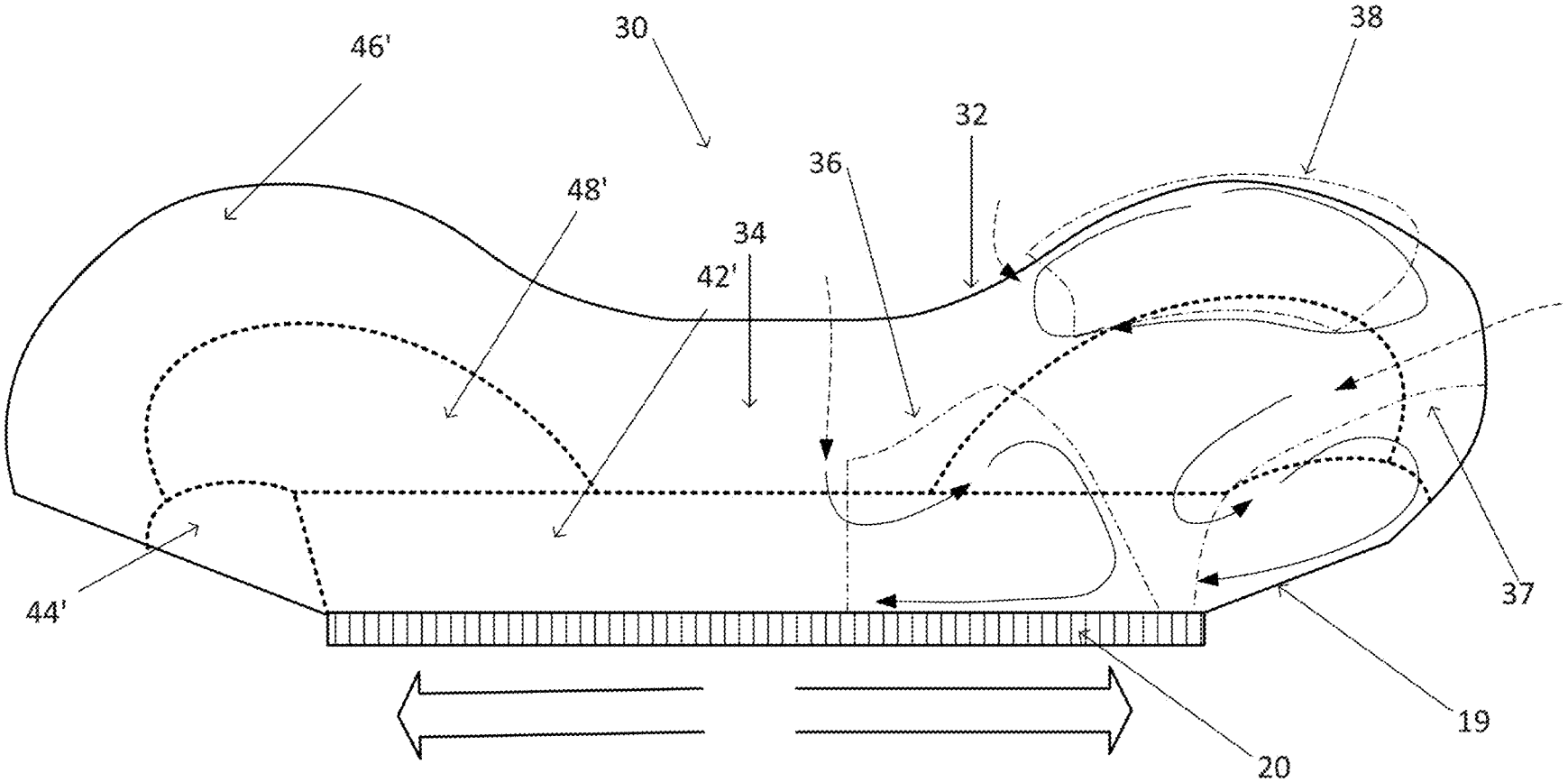
FIG. 3 illustrates as exemplary wave pool for generating different zones having different wave characteristics according to embodiments of the disclosure.

FIG. 3 illustrates an exemplary wave pool 30 for generating different zones having different wave characteristics according to embodiments of the disclosure. In an exemplary embodiment, the pool profile 32 and the pool floor 34 may be contoured to define a desired wave profile and to create multiple wave zones 36, 37, 38.

In an exemplary embodiment, multiple wave zones 36, 37, 38 may be created. The creation of multiple wave zones may be generated from a single wave generation cycle of the chambers. For example, the one or more chambers may release individually, or in sequence, such as in groups, or together in unison, to form a first wave. That first wave may change profile, height, direction, etc. The wave may also deteriorate or reform based on the underlying topography of the pool floor. As illustrated, three wave zones are generated for a single wave generation cycle on one side of the pool. The pool may have a mirror configuration, such that the entirety of the pool has six wave zones. However, three of the wave zones are independent from the other three of the wave zones since a different wave or portion of the wave creates the first three wave zones than the wave or another portion of the wave that creates the second three wave zones. Any combination of wave zones may be generated and the combination of two sides of three for a total of six zones is illustrative only. In an exemplary embodiment, the wave pool may have one, two, three, or more wave zones. The pool may have a mirrored configuration such as in FIG. 1A, thereby doubling the wave zones or the pool may be a single side as in FIG. 1B. The opposing sides of the pool may also be configured differently, such that different wave zones may be created across the entirety of the pool.

As illustrated, a first wave zone 36 is adjacent the wave generating chambers. The wave at this portion is at its highest. This area may be for the most experienced riders. It may also be for the short board riders.

As illustrated, a second wave zone 37 may be in an area of the pool after the wave leaves the chambers 20 that runs along a sidewall 19 or edge of the pool 30. The wave will dissipate energy and reduce height after the wave propagates away from the chambers 20. This area is therefore created for intermediate riders and longboard riders.

As illustrated, a third wave zone 38 may be adjacent the side of the pool away from the chambers 20. The edge may correspond to a shore area 46' of the pool. This area may have a shallow depth and may have an inclined floor bottom. The third wave zone 38 may be for beginning wave riders. This area may also be used for boogie boards, foam boards, kayaks, or skimming boards. This area may also be used for body riding or wave jumping.

The bottom of the pool 30 (pool floor 34) may have areas that correspond or influence the wave zones. For example, a first area 42' of the pool floor 34 may generally correspond to the first wave zone 36, while a second area 44' of the pool floor 34 may generally correspond to the second wave zone 37, and a third area 46' of the pool floor 34 may generally correspond to the third wave zone 38. A fourth area 48' and other areas may be used to generate and separate the different wave zones and be used to reform waves as the wave propagates from the chambers 20. The different areas of the pool floor 34 are discussed more fully with respect to FIG. 4.

The different pool floor bottom areas may be used to influence a wave profile. For example, the depth of the pool floor 34 may influence a wave size, while the slope of the floor may affect the wave shape. The first area 42' adjacent the chambers 30 may therefore generate a wave zone 36 for the most experienced riders. This area may be approximately 2-6 meters deep. This area may therefore have a pool floor bottom with a greater slope or incline toward the shore or opposing side of the pool 30 or may have the greatest depth. The third area 46' may be adjacent the short or edge of the pool 30 away from the chambers and may generate a wave zone 38 for the most inexperienced riders. This area may therefore have a pool floor bottom with the smallest slope or incline toward the edge or may have the shallowest depth. The gentler slope may make the wave brake softer.

In an exemplary embodiment, the edge of the pool 30 away from the chambers 20 may also be contoured to influence the wave characteristics. For example, in the area of the third wave zone 38, or the area for beginners, the edge may be elevated toward a middle of the pool 30, on an opposite side of the pool 30 from the middle chambers 20 of the series of chambers 20. This elevation may form a shore or dry indentation into the side of the pool. As the wave propagates across the pool from the chambers 20 toward the shore, the wave may wrap around the elevation extending into the pool area. Other or additional elevations may be provided along the short to create additional wave zones. In an exemplary embodiment, an elevation may be used to separate or redirect a wave.

As illustrated, the chambers 20 may release water into the pool individually or in sequence generating a wave. If the chambers release beginning at the middle of the sequence of chambers (i.e., middle of all of the chambers shown) and then open in opposing directions toward each end, both left and right waves will propagate from the chambers and break at approximately the same time. The release of water from each set of chambers may also be delayed or offset, such that the left and right breaking waves may be staggered. The expert wave zone may be defined as an area adjacent or proximate the chambers 20. The wave within the expert wave zone may break along the wave-generating wall. The wave may retain an approximate constant height by means of the controlled release of water from the chambers 20 to maintain the wave formation. In an exemplary embodiment, the wave height in the expert wave zone may be approximately 1.5 to 3.5 meters. After the wave leaves the area proximate the chambers 20, the wave will dissipate energy and the wave height will decrease. The wave extending along the side edge of the pool away from the chambers 20 may form the intermediate wave zone with a wave height that is reduced from the expert wave zone. In an exemplary embodiment, the wave height in the intermediate wave zone may be approximately 1-2 meters. The wave height may continue to decrease as it travels away from the chambers 20. The wave may thereafter break along the opposite side of the pool in the shallow are to create a bigger wave zone. In an exemplary embodiment, the wave height in the beginning wave zone may be approximately 0-1.5 meters.

Figure 4:
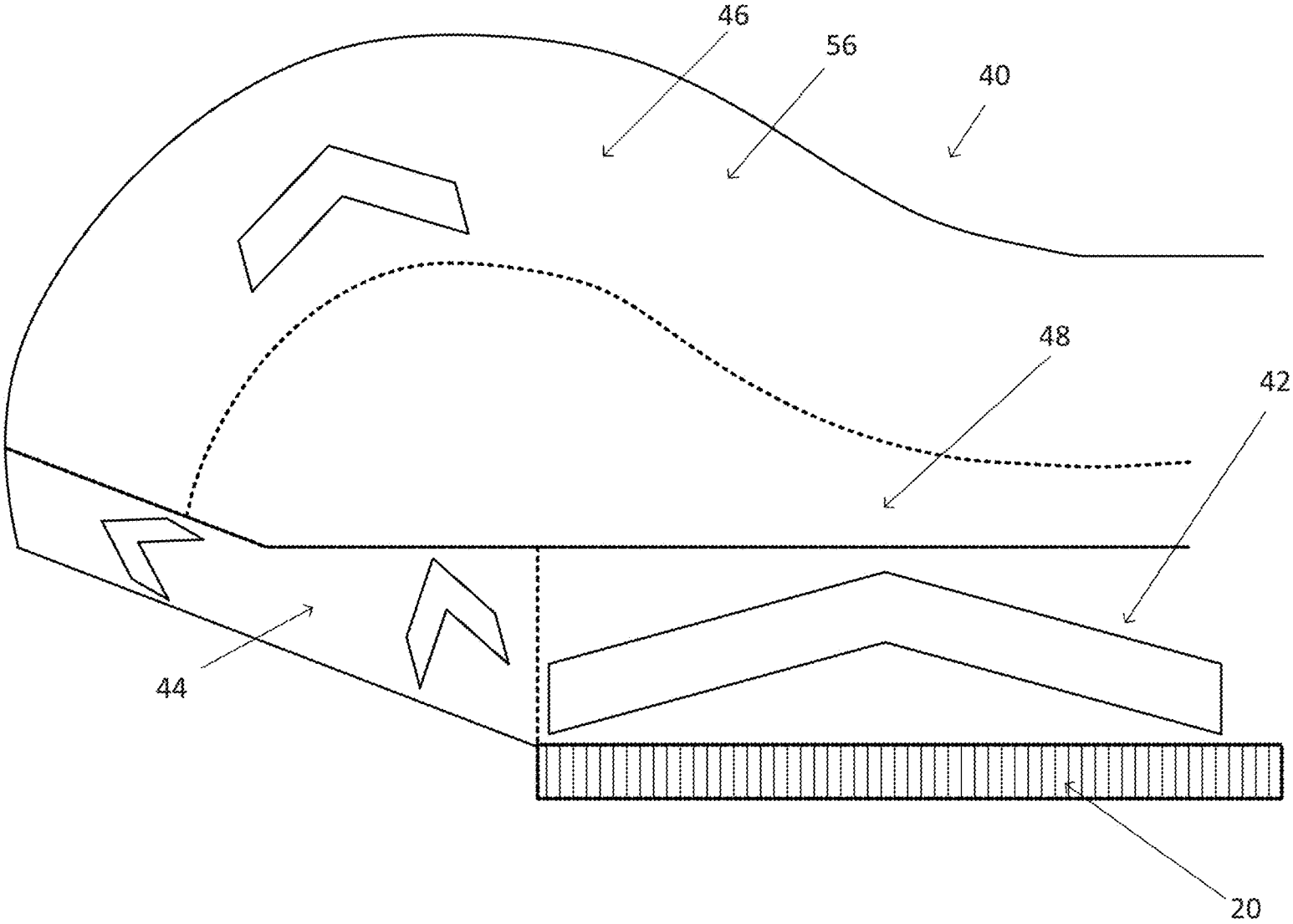
FIG. 4 illustrates an exemplary bottom zones corresponding to the different zones described in FIG. 3.
Figure 5A:
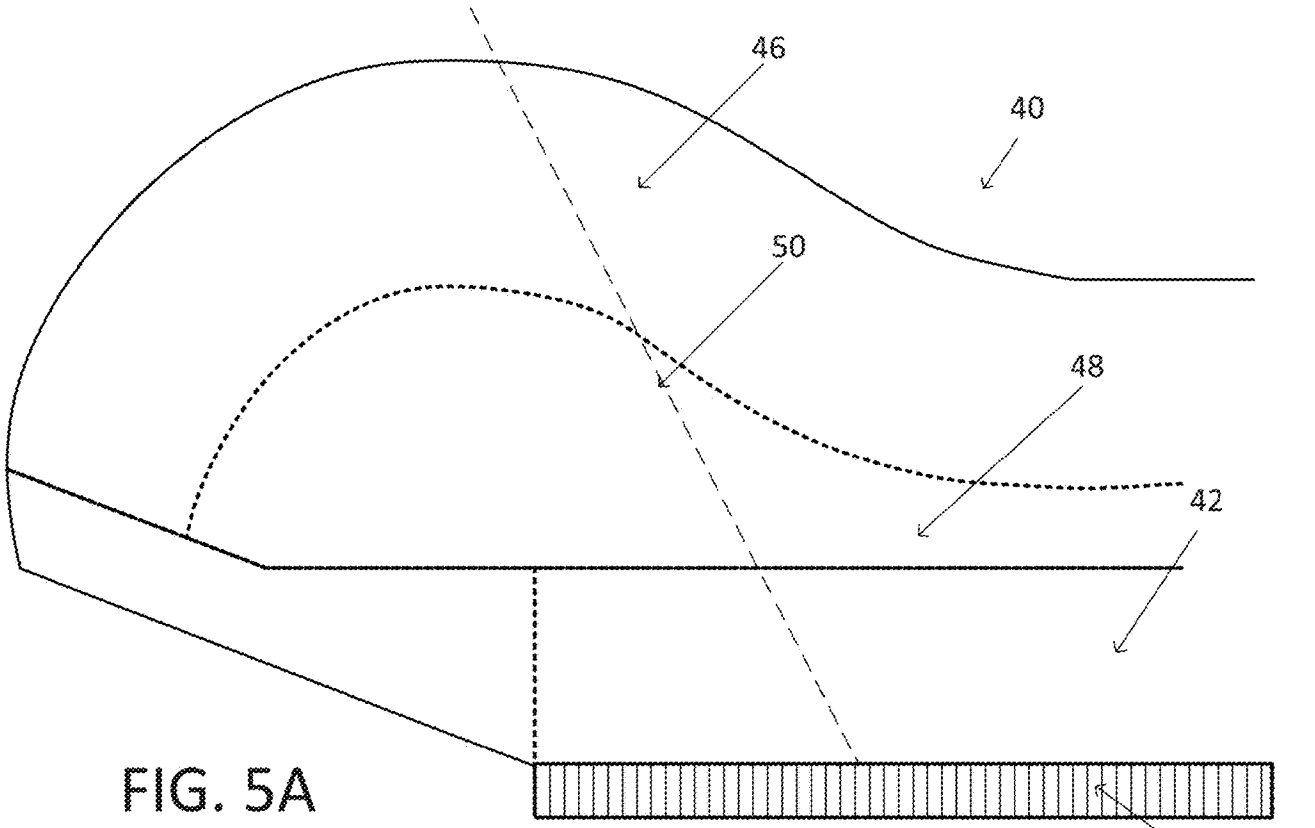
FIG. 5A and FIG. 5B illustrate the different bottom profile of the exemplary bottom zones of FIG. 4.
Figure 5B:
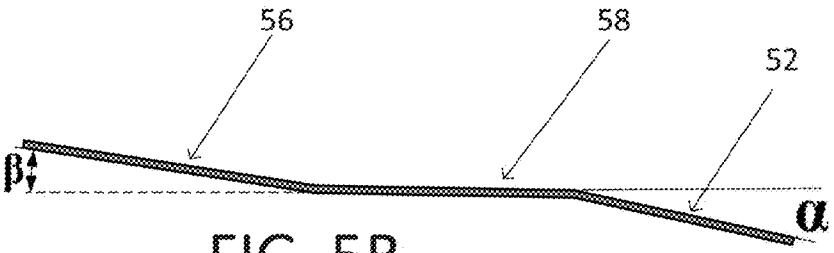

FIG. 4 illustrates an exemplary bottom profile corresponding to the different wave zones described in FIG. 3 of a pool wave system 40. FIG. 5A is the illustration of the exemplary bottom profile of FIG. 4 with a reference line 50. FIG. 5B illustrates the cross sectional perspective along the reference line 50 of FIG. 5A to illustrate the pool floor. As illustrated, the bottom profile may include at least three areas.

In an exemplary embodiment, a first area 42 may correspond to the area proximate the chambers 20. As seen in FIG. 5B the pool floor 52 of this area may include a gradual slope upward such that the pool adjacent the chamber is deeper than the pool on an opposing side of the area 42 from the chamber 20. The slope may traverse from deeper to shallower moving across the area away from the chambers at an angle $\alpha$. The first area 42 may be generally rectangular and extend directly in front of the chambers as illustrated in FIG. 4. The first area 42 may also be flared at the ends such that the area traverses in front of the chambers and as the area slopes away from the chambers extends outward past the ends of the chambers, as illustrated in FIG. 3. Other shapes of this area are also contemplated.

In an exemplary embodiment shown in FIG. 4, a third area 46 may correspond to the area on an opposite end of the pool from the chambers 20. The third area 46 may be on a side of the pool corresponding to an end of the wave travel that is opposite from the origin of the wave. The pool floor 56 of this area may have a more gradual slope than the slope of the area adjacent the chambers 20. The pool floor 56 may include a gradual slope upward such that the pool toward the first area 42 is deeper than the area on an opposite side thereof. The terminal end of the third area 46 may have a zero depth such that the water washes up the side to the surface of the water. The third area 46 may approximate a beaching area. The slope may traverse from deeper to shallower moving across the area in a direction away from the chambers at an angle $\beta$. This area may correspond to a band or width at the terminal end of the wave at an opposing side of the pool from the chambers. As the chambers 20 may generate a wave that propagates away from the chambers 20 in an oblique angle and not directly perpendicular to the chambers 20, the opposing end of the pool may be offset and include a portion of the pool that ends past the lateral end of the chambers. Opposite may therefore include directly or geometrically opposite as well as opposite based on the propagation of the wave generated from the chambers.

As illustrated in FIGS. 4 and 5, the third area 46 may be shaped in a curve such that portions of the third area 46 are further away from the chambers 20 than other portions of this area. For example, the shore area 46' may be curved such that portions adjacent the lateral side of the pool corresponding to the ends of the chambers 20 and toward a middle of the shore (for a mirrored pool such as shown in FIG. 3) or the opposite lateral side of the pool (for a single sided pool) are positioned closer toward the chambers than areas there between. As illustrated in FIG. 3, the shore region or the side of the pool opposite the chambers 20 may therefore include three curved regions, two outside regions on opposing ends of the shore region in which the region is concave with the inward concavity toward the chambers, and an interior curved region between the two outside regions in the middle of the shore region is convex with the outward concavity toward the chambers.

As illustrated, a second area 44 may extend from the first area 42 to the third area 46. This area may be similarly sloped. The slope of the area may be linear, curvi-linear, or curved. This area may include a gradual slope that transitions the bottom surface from the first area 42 to the third area 46. This area may also be contoured to provide a transition to any other area that may be included in the bottom profile. The second area 44 may therefore provide a transitional surface between two or more other floor bottom surfaces or areas.

The pool may include one or more other floor areas defining one or more other zones. For example, the first wave zone may be separated from the third wave zone. The separation may be to create a floor profile to recreate a desired waveform. The separation may be to permit space between the various wave zones for rider safety and enjoyment. As seen in FIGS. 3, 4, and 5, a transition area 48, 48' may be used. The transition area 48, 48' may correspond to floor bottom 58 that is generally flat. The transition area may be positioned between the first area 42 and the third area 46 and the shore area. As illustrated in FIG. 3, the first area 42' may contact the third area 46' in a middle portion of the pool, while the transition section 48' separates the first area 42' from the third area 46' toward outer lateral sides of the pool adjacent the second area 44'. In an exemplary embodiment, such as illustrated in FIG. 4, the transition area 48 may separate the first area 42 from the third area 46 along a length of the pool, such that the first area 42 does not contact the third area 46.

In an exemplary embodiment, the gradient of the pool floor bottom 52 corresponding to a first area 42, 42' is greater than the gradient of the pool floor bottom 56 corresponding to the third area 46, 46' ($\alpha>\beta$). In an exemplary embodiment, the gradient of the pool floor bottom of the second area 46, 46' is generally equal to either of or between the gradient of the first area and the second area ($\alpha\geq\theta\geq\beta$). The pool floor bottom 52 may have a slope of between 3 and 10 degrees. The pool floor bottom 56 may have a slope of greater than 0 degrees to 5 degrees. The pool floor bottom corresponding to the second area 46, 46' may have a slope of between 2 and 10 degrees.

The configuration, shape, elevation, slopes, and other features of the pool floor bottom described herein are exemplary only. Other or additional features may be added and are within the scope of the present description. For example, an additional sloped floor or one or more other level floor areas may also be included to create additional wave areas or separate wave areas. Other elements may also be included, such as floor configurations, walls, dividers, elevations, shore features, etc. to further enhance the surfing experience or to provide additional benefits to the pool wave generator described herein. These may include features for splitting, redirecting, reforming, or otherwise effecting the generated wave.

Figure 6:
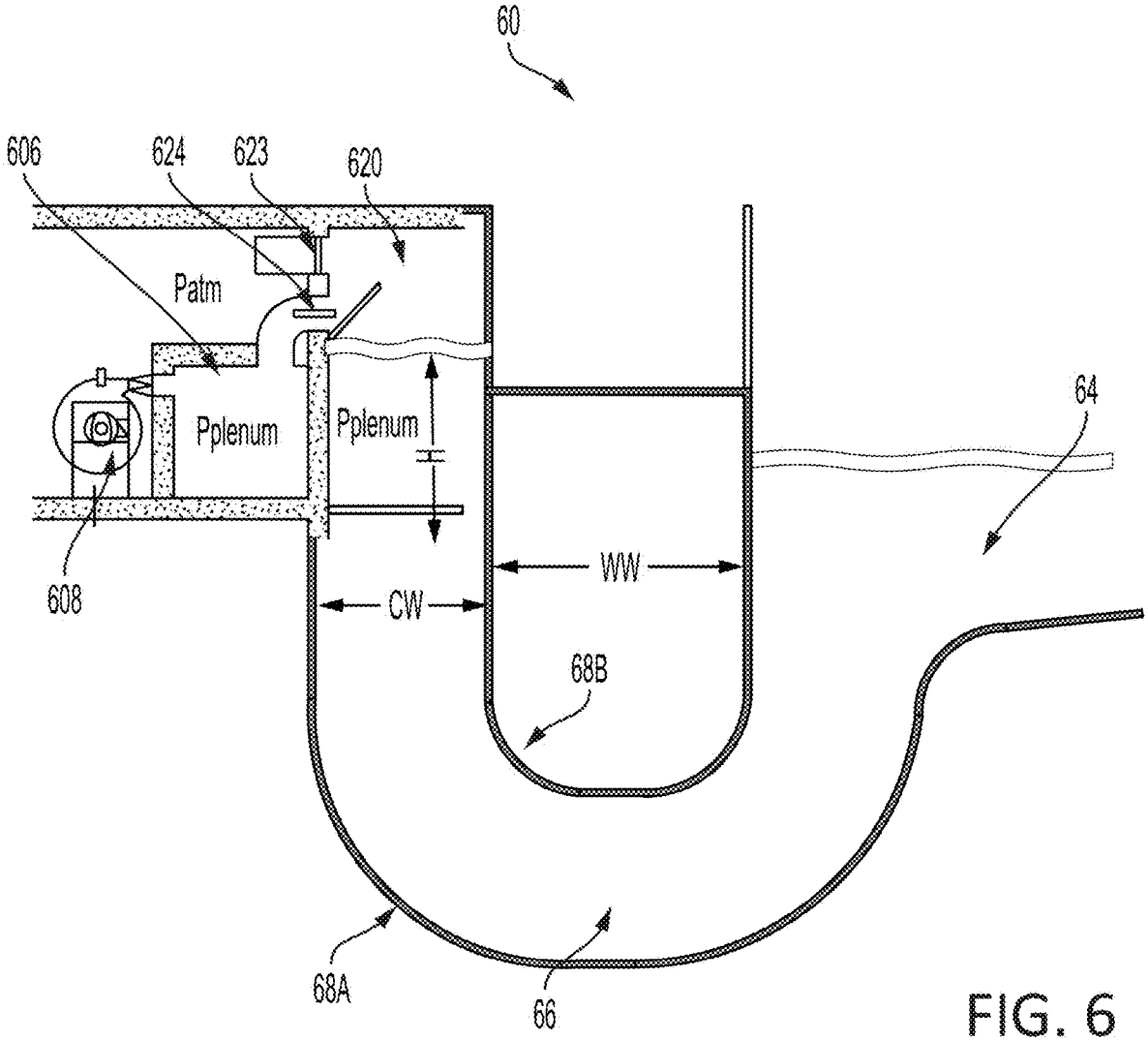
FIG. 6 illustrates an exemplary wave-generating chamber according to embodiments of the disclosure.

FIG. 6 illustrates an exemplary wave-generating chamber according to embodiments of the disclosure.

Conventional chamber configuration in which the chamber and pool share a common wall or in which the chamber and the pool are in close proximity create eddy currents through the area between the chamber and the pool. The eddy currents may interfere with the shape and stability of the generated wave. U.S. Pat. No. 10,526,806 discloses a vane positioned between or near the chamber and pool interface to control and direct the water movement and reduce the formation of eddy currents. Such systems create construction and maintenance costs as the vanes must be internally supported and maintained. Exemplary embodiments describes herein permit the formation of a wave pool that may manage or reduce the formation of eddy currents without the use of a vane or an internal structure within or adjacent the water flow path between the chamber and pool.

As shown in FIG. 6, the chamber 620 and the configuration of the chamber 620 to the pool 64 may be used to generate waves of desired characteristics. Exemplary embodiments use the chamber width (CW) and the width between the pool and the chamber (wall width) WW. In an exemplary embodiment the width between the pool and the chamber, WW, is greater than 2 meters. The greater distance in this transition area between the chamber and the pool, however, can affect and reduce the height of a generated waved. Therefore, conventionally, it was desirable to keep this area as short as possible. This distance, however, can be used to reduce turbulence and create a better wave profile. In an exemplary embodiment, the distance between an edge of the pool and an edge of the chamber is between 2 and 7 meters. The CW may influence the resulting height of the generated wave. Similar to the WW, this dimension conventionally was reduced as the additional width necessitated additional power for controlling and releasing the wave. For example, additional gas would be needed to create the same pressure on the water surface. The CW is preferably 1.3 to 5 meters.

In an exemplary embodiment, the chamber 620 may be coupled to the pool 64 by a passage 66. The passage 66 may be positioned at a depth lower than the pool 64, such that water exits the chamber 620 and enters the pool 64, on the bottom of the pool or adjacent to the bottom of the pool. The passage 66 may be shaped such that the direction of water leaving the passage may have a vertical component. The passage 66 may include an inner wall 68B and an outer wall 68A. The inner wall 68B and outer wall 68A may be curved to reduce turbulence imposed on the water as it passes through the passage 66 from the chamber to the pool.

Exemplary embodiments described herein include chamber and control systems and methods. Exemplary embodiments of the chamber and control systems and methods described herein may be used alone or in combination with any of the features described herein. For example, the exemplary chamber and control system may be used in the configuration in which the chamber shares a common wall with the wave pool 64. Exemplary embodiments may be used in which water is retained and released from one or more chambers 620 in order to control the fluid flow in and out of the chamber 620.

As seen in FIG. 6, exemplary embodiments may include the chamber 620 as described herein for retaining and releasing water into the wave pool 64 to generate a wave or other water action within the pool. In an exemplary embodiment, the chamber 620 may have one or more valves in order to permit the ingress and egress of water and air to and from the chamber. As illustrated, an exhaust valve 602 and injection valve 604 are provided for venting air out of the chamber and supplying air into the chamber, respectively. In one embodiment, the exhaust valve 602 and the injection valve 604 may be the same valve. The valve(s) may therefore be one-way valves or bi-directional valves. The chamber 620 may also be in fluid communication with a plenum 606 in order to supply additional air, on demand, to the chamber 620. The plenum 606 may be coupled to a pump 608 to supply pressurized air to the chamber 62. In an exemplary embodiment, the chamber 620 may also be configured to vent under pressure, such as through a pump or other suction to provide negative pressure within the chamber 620, or to quickly evacuate the air from within the chamber 620.

In an exemplary embodiment, one or more of the valves may be open or closed valves such that the valve transitions from fully open to fully closed.

In an exemplary embodiment, one or more of the valves may be actuated such that the one or more valves can be controlled to be fully open, fully closed, or partially open, as also described above with respect to FIGS. 2A-2C. In an exemplary embodiment, the one or more valves may be mechanically, pneumatically, or otherwise actuated to permit the full positional range between open and closed. In an exemplary embodiment, the one or more valves may be mechanically, pneumatically, electrically, or otherwise actuated to permit step wise positioning of the valve within the range between fully open and fully closed. Exemplary embodiments of the chamber and control system described herein may use the intermediate positioning of the one or more valves in order to control the water displacement in the chamber 620. In an exemplary embodiment, the control system and method may be used to adapt wave frequency to avoid or minimize main wave conflict with residual waves. In an exemplary embodiment, the control system may include one or more parameters that can be used to customize a wave characteristic. The wave characteristic may include wave height, wave shape, wave contours, etc. Exemplary embodiments may use the combination of the valve controls, including the permissible intermediate positioning of the valves as one or more parameters for wave creation that may be used to generate more wave combinations. Exemplary embodiments of the control system described herein may reduce power consumption by approximately 10%. Exemplary embodiments of the control system described herein may lower the total installed power of an installation.

Figure 7A:
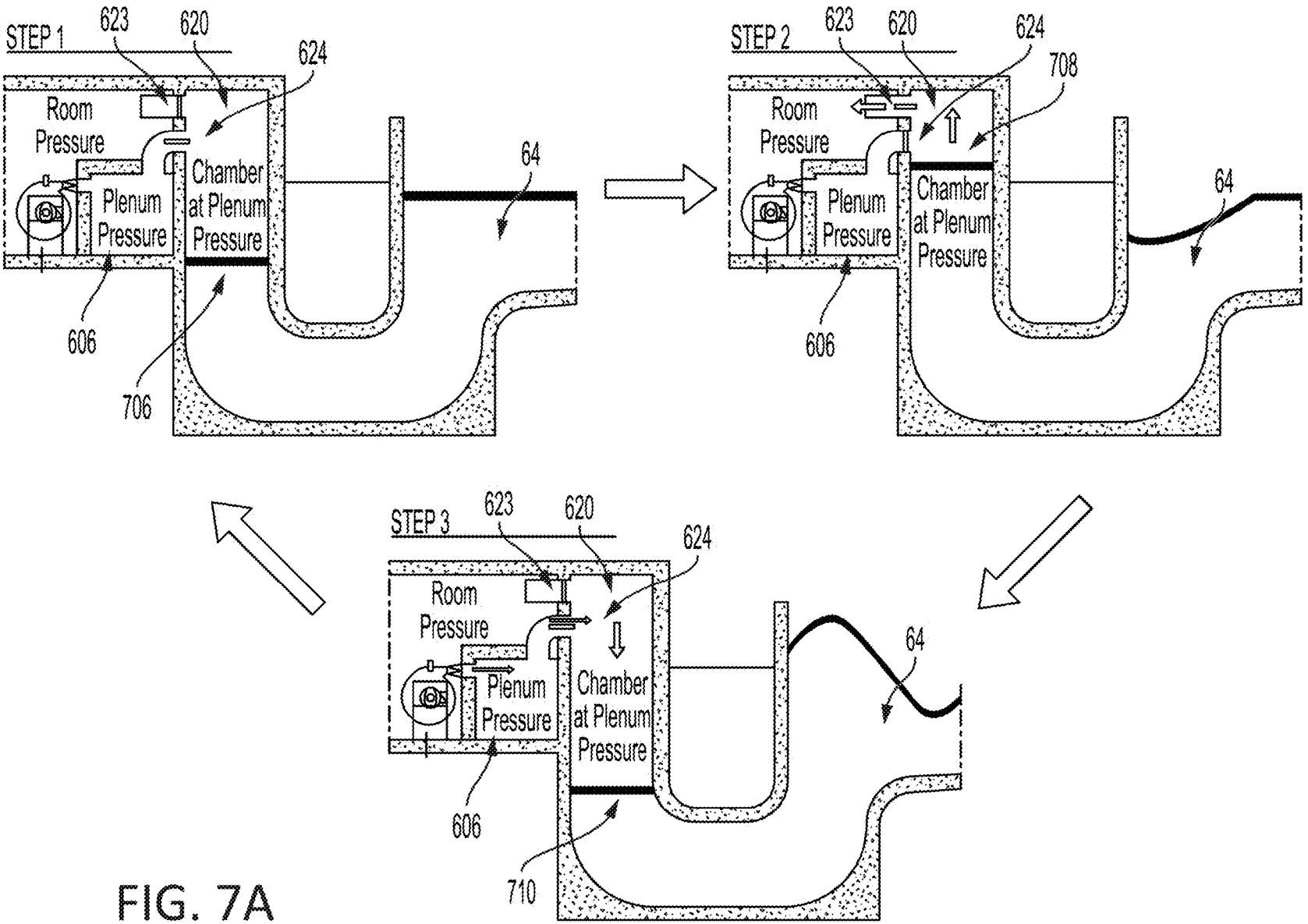
FIG. 7A illustrates an exemplary progression of a wave being generated from the wave-generating chamber of FIG. 6.

FIG. 7A shows an exemplary progression of a wave being generated from the wave-generating chamber 620 of FIG. 6. The first step illustrated in FIG. 7A is when the wave chamber 620 and wave pool is ready to be fired to produce a wave. In this initial state, the vent valve 623 is fully closed, the ingress valve 624 is fully open. The ingress valve 624 permits pressurized air in the plenum 606 to enter the chamber 62 and apply pressure on the water of the chamber to create a low water level, below the water level in the wave pool. At the second step illustrated in FIG. 7A, the chamber 62 pressure is released. The vent valve 623 is fully opened, and the ingress valve 624 is fully closed. The air pressure in the chamber 62 is therefore released, and the water in the chamber rises. The rising water in the chamber 62 creates a void of water in the wave pool as water moves from the wave pool in to the chamber 62. This movement creates a local reduction in the water level height in the pool at an area adjacent the chambers 62. At the third step illustrated in FIG. 7A, the chamber pressure is again increased to release the water from the chamber. As illustrated, the vent valve 623 is fully closed, while the ingress valve 624 is fully open. This permits the pressurized air to push against the water and eject the water from the chamber 62, through the passage, and into the wave pool. As illustrated, a wave is generated in the pool as the water is pushed from the chamber 62 and into the pool 64.

When the valves are used in this configuration, such that the valves are configured to transition between fully closed and fully open states, the air within the chamber can act as a spring. As the water within the chamber reaches a maximum or minimum height, the water level may bounce as the air is compressed and released, creating an oscillating wave surface.

Figure 7B:
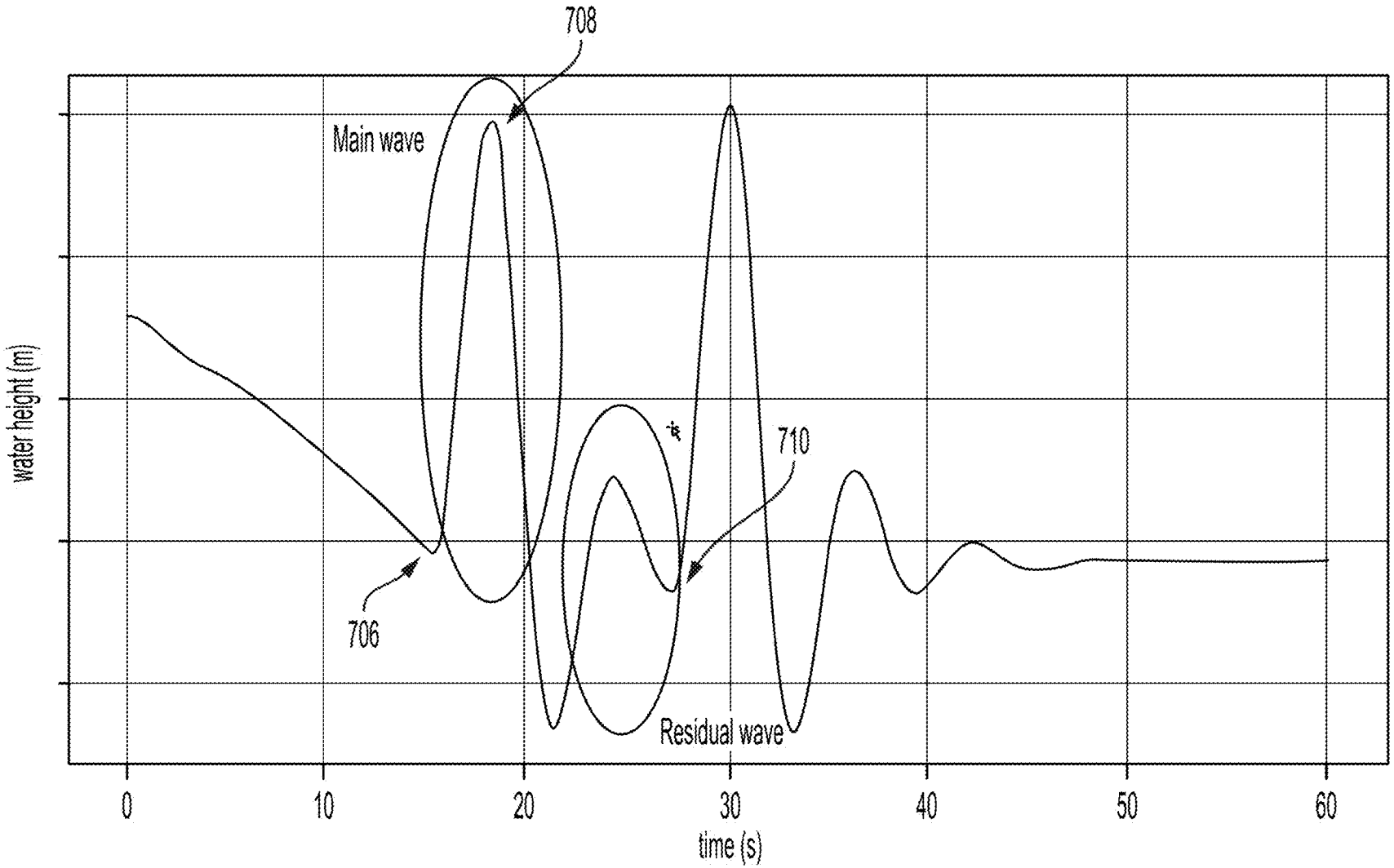
FIG. 7B illustrates an exemplary graph of the water levels within the wave pool at different times associated with the exemplary progression of the wave of FIG. 7A.

FIG. 7B illustrates an exemplary graph of the water levels within the chamber at different times associated with the exemplary progression of the wave of FIG. 7A. As is seen in the comparison with the water states from FIG. 7A, the water level in the chamber 62 is at a lower point/resting level 706 to start. When the air is vented, the water enters the chamber 62 and the water level increases to a maximum position 708. When the air is injected, the water exits the chamber and the water goes to a minimum. As best illustrated between the second and third states in which the chamber 62 is transitioning between the venting state and pressurizing state and the water is taken into the chamber 62 and then released from the chamber, the water level after reaching the minimum goes back up. However, the residual air in the chamber 62 creates another oscillation in the chamber water height, a residual wave, before the water level returns to the original lower point/resting level position 710.

Figure 7C:
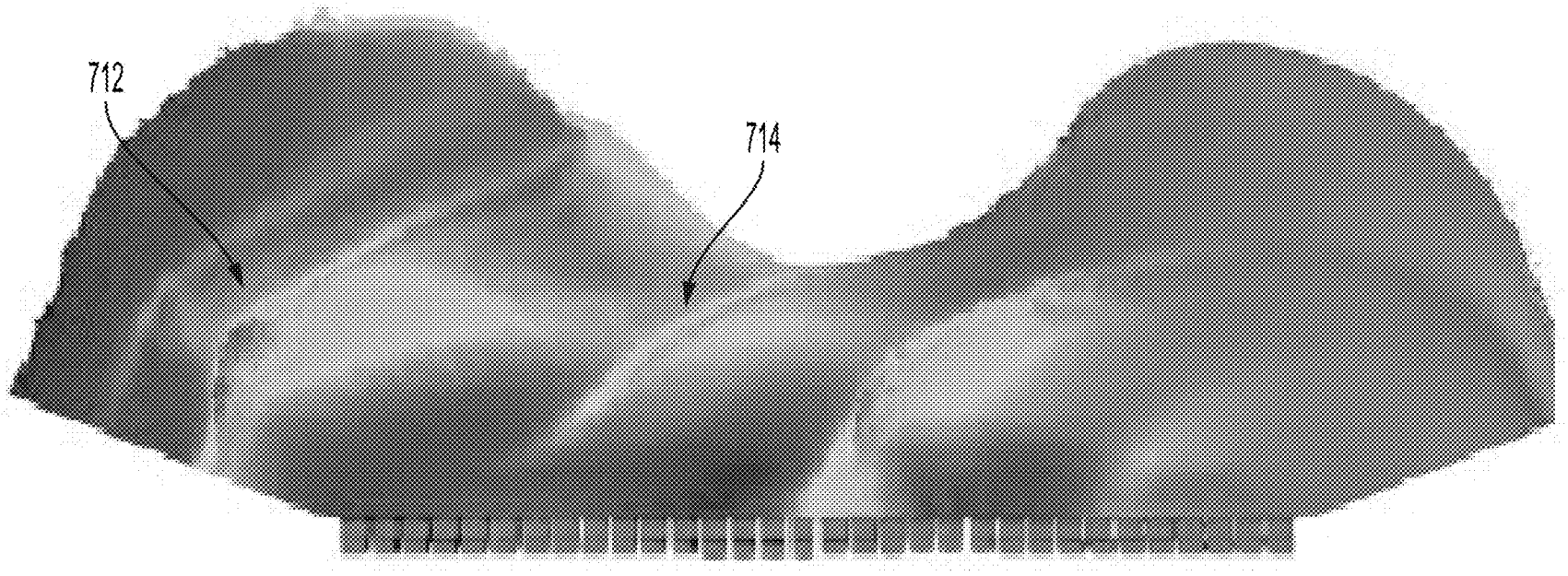
FIG. 7C illustrates an exemplary wave pattern formed in the wave pool corresponding to the wave amplitude graph of FIG. 7B.

FIG. 7C illustrates an exemplary wave pattern formed in the wave pool corresponding to the wave amplitude graph of FIG. 7B. The water height in the chamber 62 at maximum and minimum creates the desirable rideable wave or main wave 712. However, the intermediate oscillation that may occur within the chamber 62 can cause an interfering water action between the desired waves. The interfering water action may be like a lesser or smaller residual wave 714 between the desirable wave action.

In an exemplary embodiment, the valve system may be controlled to position the one or more valves at an intermediate position between open and closed to dampen the oscillation created within the chamber 62 by the movement of air and water within the chamber, thereby maintaining the water level within the chamber at a desired height. For example, in an exemplary embodiment, Between the steps 2 and 3, instead of the vent valve transitioning from fully open to fully closed, while simultaneously transitioning the ingress valve from fully closed to fully open, the vent valve may fully close and may thereafter remain partially open or remain partially open through the transition between steps 2 to 3. Alternatively, or in addition thereto, the ingress valve may be opened by varying amounts during the transition between step 2 and 3 in order to control the influx of air into the chamber 62 and dampen any spring action resulting from the injected air within the chamber 62.

Figure 8:
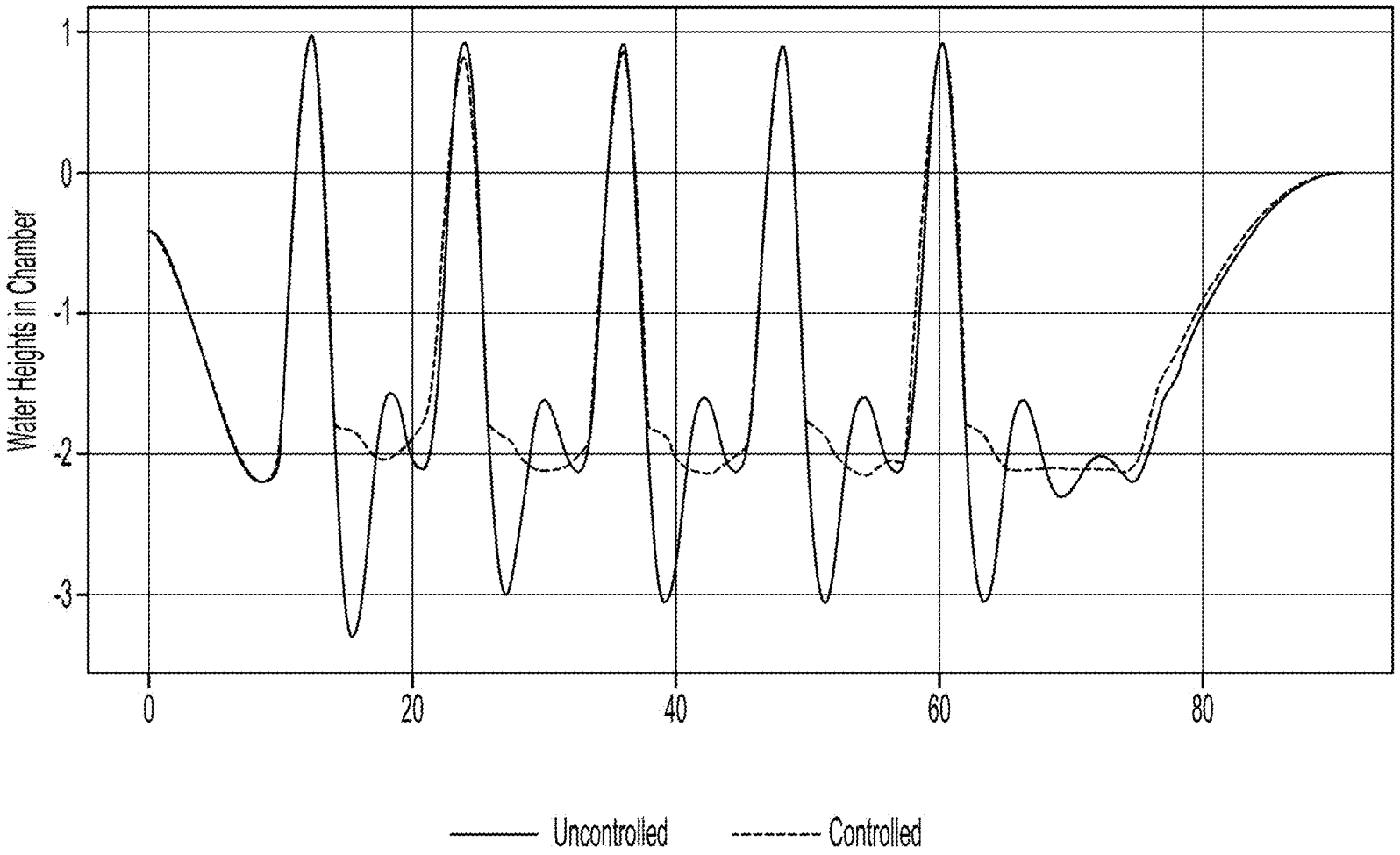
FIG. 8 illustrates an exemplary comparison of wave amplitudes on a time progression graph for water within the wave pool using the chamber and control systems according to embodiments described herein to control the desired wave patterns within the wave pool.

FIG. 8 illustrates an exemplary comparison of water amplitudes on a time progression graph for water within the chamber using the chamber 62 and control systems according to embodiments described herein to control the desired wave patterns within the wave pool. As illustrated, the original water amplitude within the chamber 62 progresses between a minimum and a maximum wave height with an oscillation as water re-enters the chamber. This can occur when the one or more vent or ingress valves are positioned between fully open and fully closed states. The comparison graph illustrates an exemplary embodiment in which the ingress valve is partially opened so that the water level within the chamber 62 does not result in the same drastic minimum, but instead includes a wave profile with a defined maximum and truncated minimum, thereby minimizing the oscillation. As shown, the uncontrolled profile results in a residual wave, while the controlled profile mitigates the production of residual waves in the chambers. Tuning parameters can vary to achieve different water height profile and different performance characteristics.

Figure 9A:
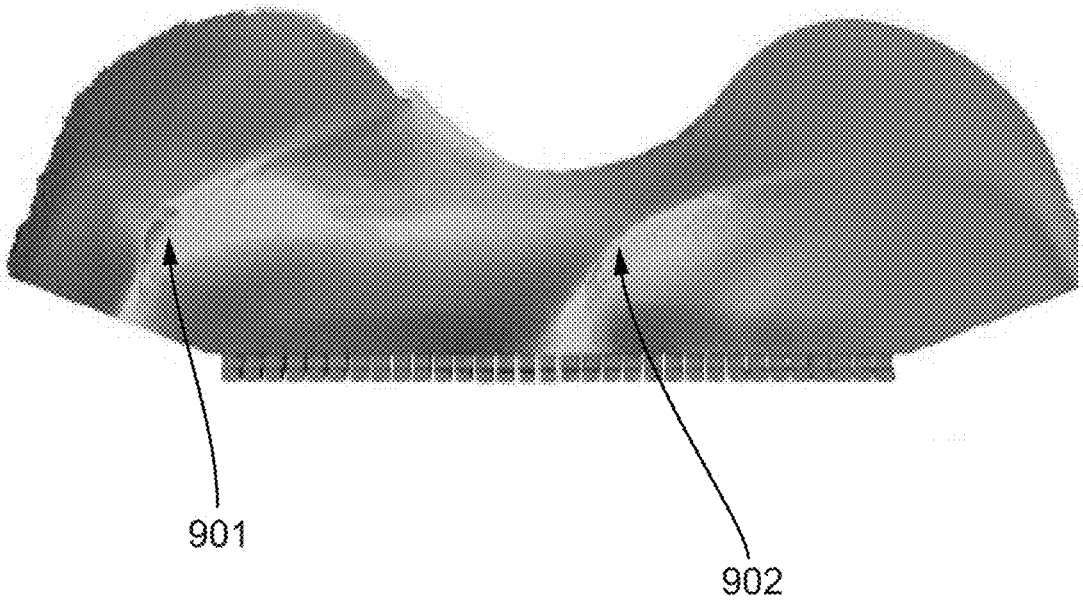
FIGS. 9A, 9B, 9C, and 9D illustrate exemplary comparisons of waves and currents generated within the wave pool using the chamber and control systems and methods described herein.
Figure 9B:
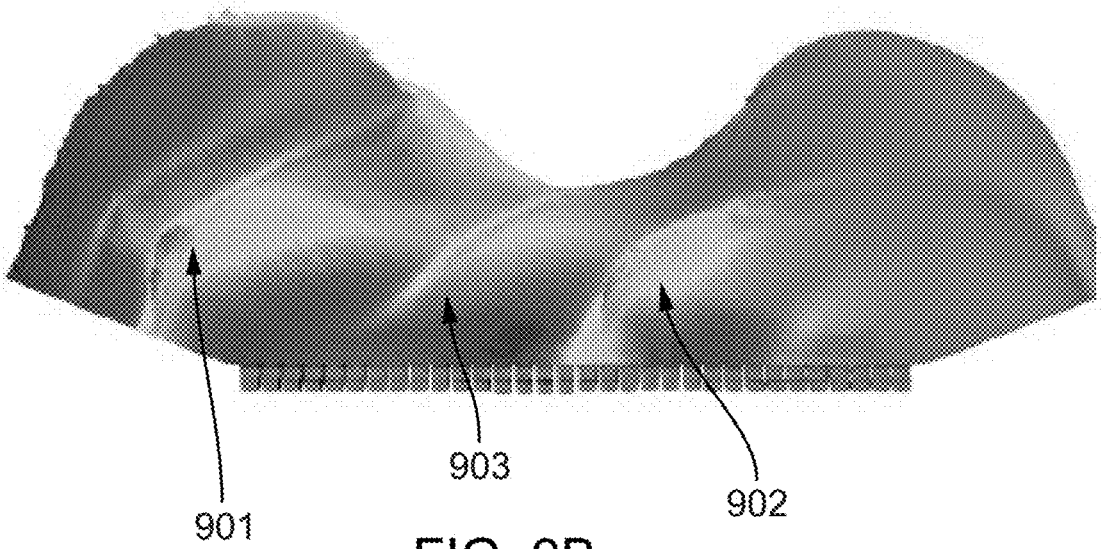

FIGS. 9A and 9B illustrate exemplary comparisons of waves (901, 902) generated within the wave pool using the chamber and control systems and methods described herein. FIG. 9A shows the generated waves (901, 902) using the chamber and control systems and methods described herein, resulting in mitigation of the residual wave (903). FIG. 9B shows a wave (901, 902) generated without the benefit of the systems and methods described herein, in which the residual wave (903) occurs.

Figure 9C:
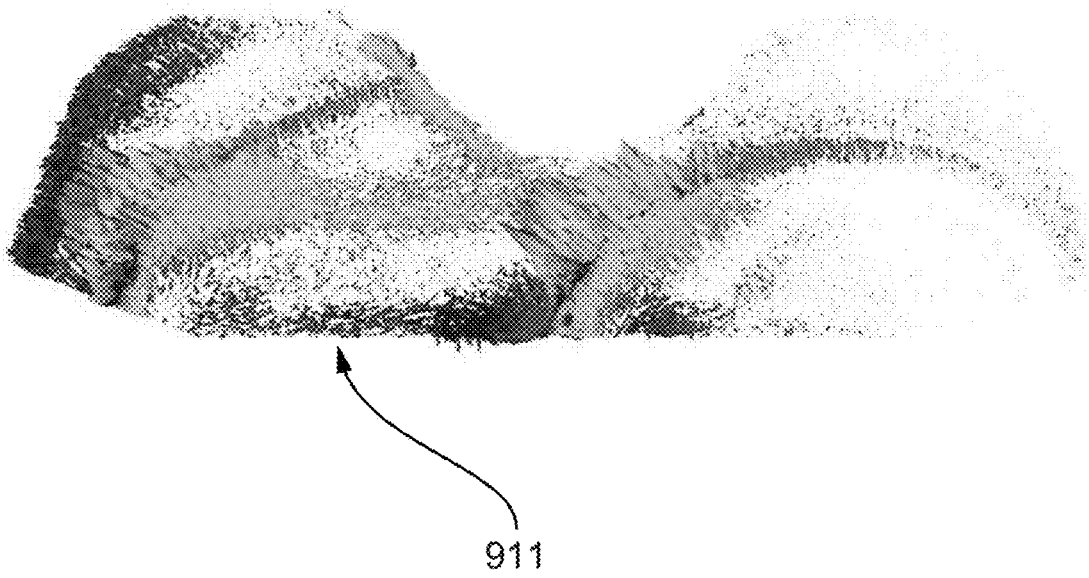
Figure 9D:
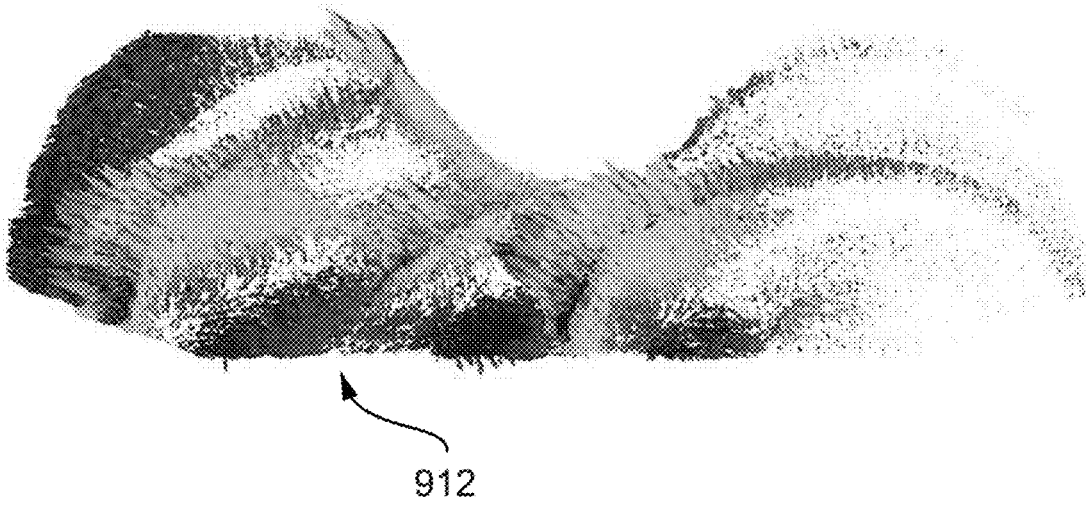

FIGS. 9C and 9D illustrate exemplary comparisons of currents (911, 912) generated within the wave pool using the chamber and control systems and methods described herein. Mitigating the residual wave significantly reduces the currents in the pool allowing for a better wave quality, as depicted in FIG. 9C (with control) and resulting in a better and safer guest/surfing experience than when no control is used, as depicted in FIG. 9D.

Figure 11:
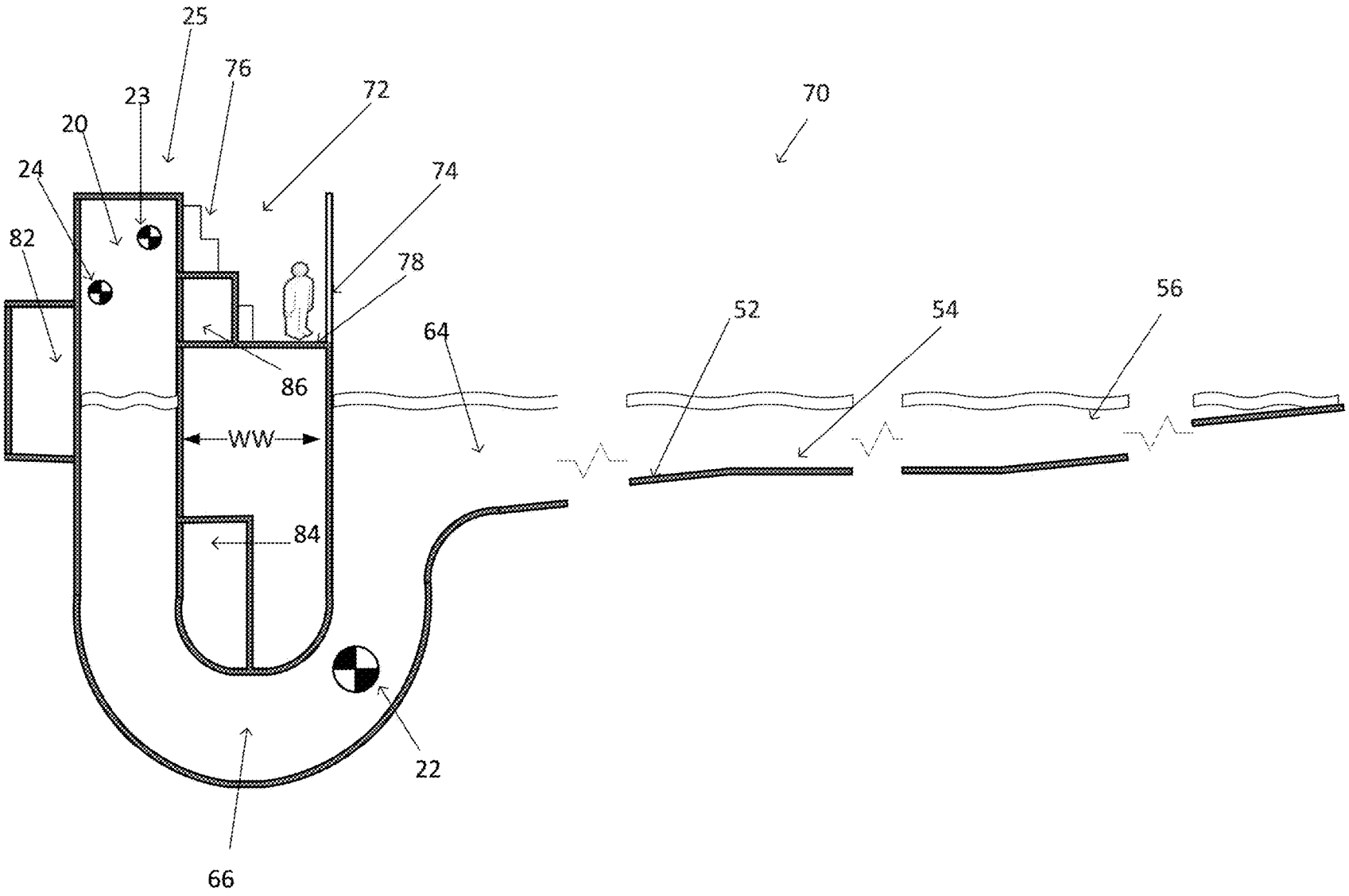
FIG. 11 illustrates an exemplary cross sectional profile of a wave pool according to embodiments of the disclosure.

FIG. 11 illustrates an exemplary cross sectional profile of a wave pool according to embodiments of the disclosure. The exemplary wave pool 70 may include any combination of features as described herein. For example, the system may include a pool 64 having a pool floor. The pool floor may have one or more different areas such as first sloped area 52 adjacent chamber 62, that transitions through a generally flat transition area 54 to a third sloped area 56. The chamber 62 may control the egress and ingress of water to and from the chamber through one or more valves 22, 23, 24 as described herein.

In an exemplary embodiment, the wave generation system may have a control system associated therewith for actuating one or more valves 22, 23, 24 for controlling the flow of water between the chamber and the pool. In an exemplary embodiment, the system includes an exhaust valve 23 for permitting the air to flow out of the chamber and an injection valve 24 for permitting the air to flow into the chamber.

Figure 10A:
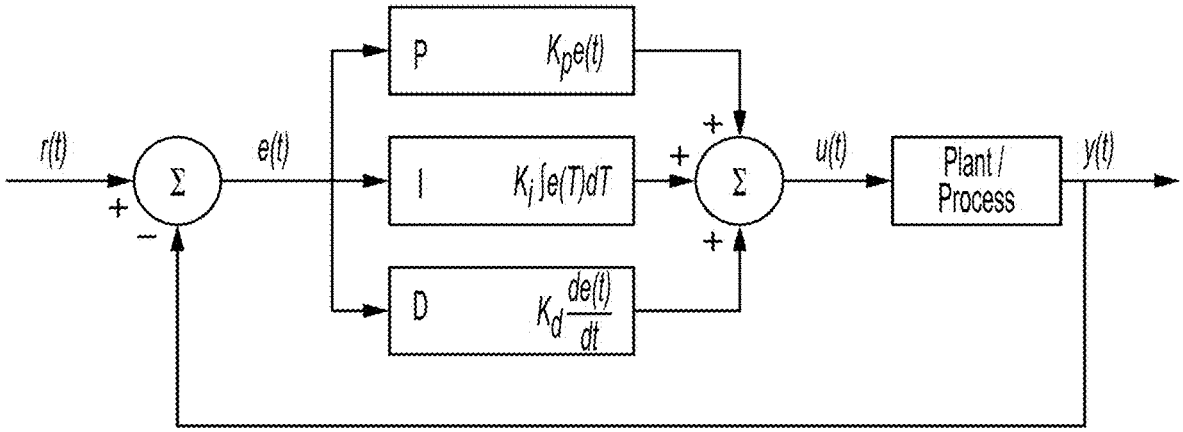
FIGS. 10A and 10B illustrate an exemplary control loop(s) for use with the valves in the controller of the chamber for defining a desired wave shape.

In an exemplary embodiment, one or more of the valves, including the exhaust valve or the injection valve may be coupled to an independent controller, such as a proportional-integral-derivative (PID) controller, proportional-integral (PI) controller, or a proportional derivative (PD) controller, to facilitate a control loop between one or more sensors of the system and the position of the one or more valves. In an exemplary embodiment, the PID controllers may follow this formula:

$$u(t) = K_p e(t) + K_i \int e(t)dt + K_p \frac{de}{dt}$$

u(t)=PID control variable
$K_p$=proportional gain
e(t)=error value
$K_i$=integral gain
de=change in error value
dt=change in time The error may be the difference between the recorded valve angles by the sensors and the set points. In an exemplary embodiment, the feedback control loop for the position of the exhaust valve may be based on a difference between the pressure sensor and a set pressure point, and the feedback control loop for the position of the injection valve may be based on a difference between the water level height in the chamber sensor and a set height point. FIG. 10A illustrates an exemplary feedback control loop in which the valves are compared in order to determine the valve position.

Figure 10B:
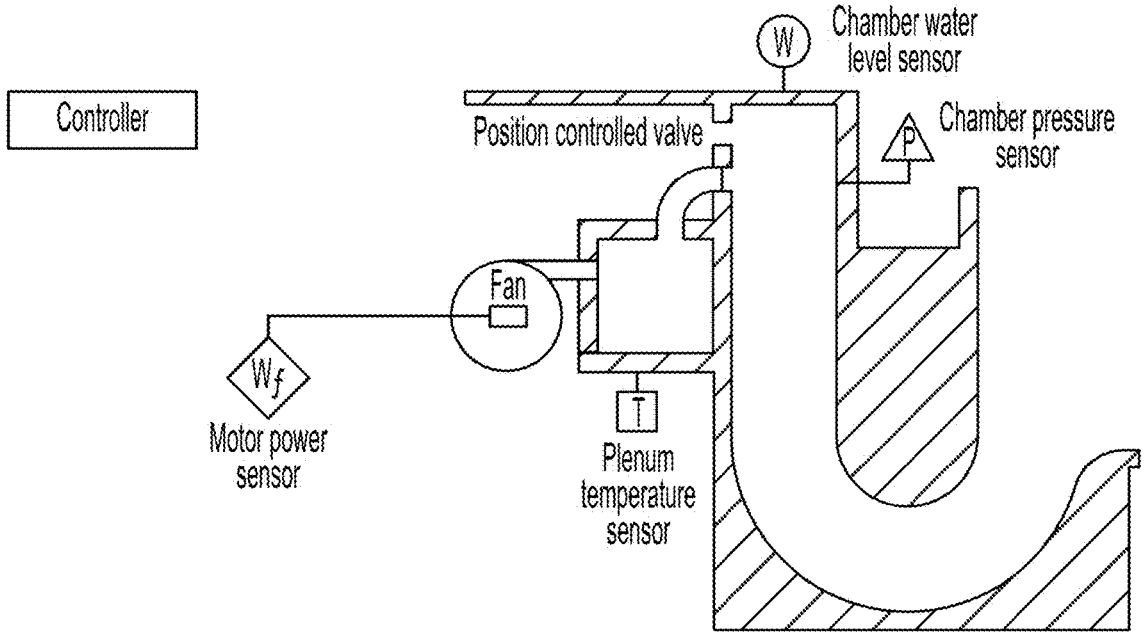

FIG. 10B illustrates an exemplary control set up for use with the injection valve. In an exemplary embodiment, as the water returns into the chamber, the water height oscillates until it reaches its final height. The water height oscillations within the chamber may be dampened by reducing the pressure given to the chamber by the plenum by reducing the opening of the intake valve. The water level may be measured by a level transmitter. The air pressure may be provided to the chamber by a valve with positional control between fully closed to fully open (0 to 100% open). In an exemplary embodiment, the intake valve opening percentage may be controlled using a PID, PI, or PD loop controller to influence the water level to the set height point, as well or alternatively to dampen the wave harmonics. The set water height point may be determined based on the wave shape or size being produced. The selection of the set height point may be tailored to influence the wave characteristics and more fully tailor a generated wave.

The present embodiment includes a position controlled valve mounted on the chamber to control the amount of air transmitted from the plenum to the chamber. A set of sensors connected to the chamber includes sensors includes, but is not limited to, a water height sensor W to measure the water level in the chambers, a pressure sensor P to measure the pressure in the chamber. Other sensors, such as a temperature sensor to measure the temperature in the chambers, a humidity sensor to measure the humidity in the chamber, or a flow sensor installed on the valves to measure the speed of the flow through the valve could be used as well. A plenum, pressurized by blower one or more fans is equipped with temperature sensors to measure the temperature in the plenum. A power sensor is connected to the motor to measure the amount of power drawn by the fan motors. Alternatively, these sensors could be replaced by amperage sensors installed on the motors electrical leads. With motors controlled by variable frequency drives (VFD), data calculated by the VFD could be used instead of sensors. In addition, one or more temperature and humidity sensors are installed in the mechanical room to measure the air density in the mechanical room.

As shown in FIG. 11, the terminal end of the pool 64 toward the chamber may be separated by the chamber by a width WW. In an exemplary embodiment, the separation between the chamber and the pool may permit spectator observation. As illustrated, the space between the pool 64 and the chamber 20 includes a floor 78 in which an observer may stand. The floor may be positioned around the water height of the pool 64 or positioned higher to provide better viewing of a rider in the area adjacent the chambers or in the rest of the pool. This area may include bleachers 76 or other sitting area or walkway to permit pedestrians or observers to pass by or observe the action within the pool.

In an exemplary embodiment, the separation between the chamber and the pool may permit storage of system components in addition to or in place of spectator observation. For example, the area between the pool 64 and the chamber 62, positioned over passage 66, may include the space for the air plenum, pump equipment, blowers, electronics, controllers, equipment room, or other system components. As illustrated, the bleacher or sitting area may incorporate an equipment room 86. The space under the floor 78 or otherwise positioned between the chamber and the pool may include other component parts, such as a space for the air plenum, electronics, controllers, or other equipment. As illustrated, the area between the pool and chamber includes a space for the air plenum 84 and behind the chamber 86 is positioned the electrical room.

In an exemplary embodiment, the space between the pool 64 and the area 72 between the pool and the chamber 62 may be open and unobstructed. In this case, a rider, swimmer, and lifeguard may be able to enter the pool area from the floor 78 on the wave generating side of the pool. In an exemplary embodiment, a wall 74 may extend beyond the height of the water to separate the space between the pool 64 and the chamber 20 from the pool 64 itself. The wall 74 may be an extension of the side of the pool over the passage entrance. The wall 74 may be of an acrylic, plastic or other semi-transparent or transparent material to permit observation of the activities within the pool at a location outside of the pool 64. The wall 74 may protect observers from getting wet or accidentally falling into the pool 64.

Exemplary embodiments described herein may include unique pool configurations for managing water flow to influence currents. Such exemplary configurations may be useful in creating and maintaining desired wave formations and in permitting repeated wave formations either in a series along a length of a pool or in time to minimize elapse time between wave formations. Exemplary embodiments may therefore include a lagoon and trough at a shallow end of a pool in order to direct water at the end of a wave. The lagoon or trough may be used to absorb and dissipate currents within the pool.

As previously described with respect to FIG. 1A, an exemplary wave pool generator may include a pool area and one or more chambers for generating a wave within the pool area. The wave 16 may propagate away from the chamber(s) and toward a terminal end of the pool. The terminal end of the pool may be created by a sloped bottom of the pool to approximate a beaching area. As the water is pushed across the pool area by the release of water from the chambers, the water may travel toward the terminal end and travel across and up the sloped bottom until the water stops and eventually comes back to the pool area along the sloped bottom under the influence of gravity. However, the water return into the pool may create currents that interfere with repetitive wave generation. Exemplary embodiments may therefore include additional water features to handle the water movement.

Figure 12:
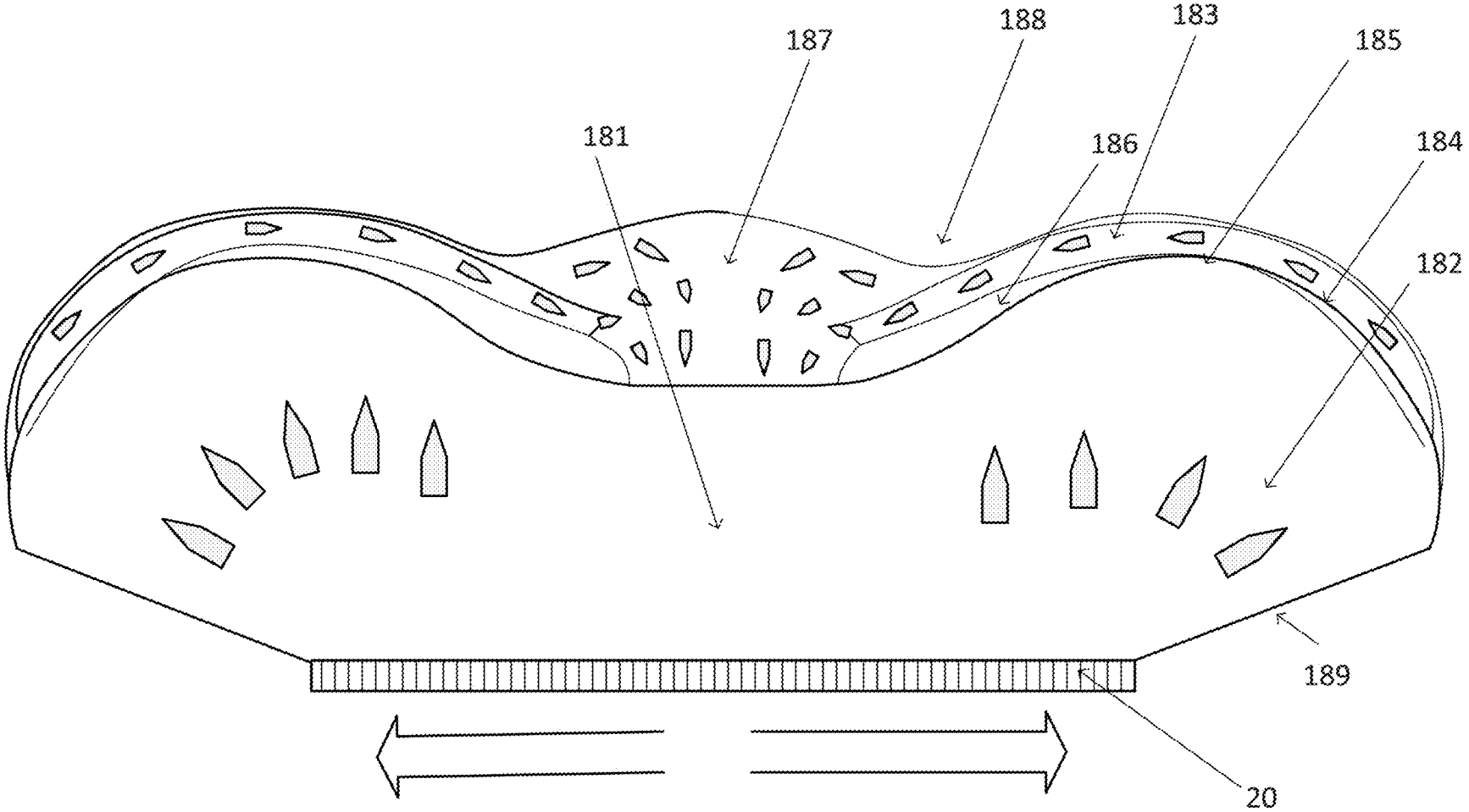
FIGS. 12, 13, 14, and 15 illustrate an exemplary wave generator according to embodiments described herein including features for managing currents and water flow. The example features may be used in any combination with any wave generator described herein.

FIG. 12 illustrates an exemplary embodiment of a wave pool with a pool area 181 and one or more chambers 20 to generate a wave 182 moving from the chambers to a shore area 185. The shore area may be created by an upwardly taper pool floor such that the water level of the pool area 181 and the pool floor meet. The incoming wave 182 may push water up on the beaching area 185, such that the location the water meets the shore varies with the progression of a wave. The shore area 185 may therefore include a high water line 184 which may be the highest level (or further away from the chambers 20) the water can reach on the beaching area 185 under a given wave progression. The high water line 184 may depend on factors of the wave generating device, including chamber release timing, pressure within the chamber, etc. A low water line may be the location along the beaching area 185 in which the water naturally rests against the pool floor without a wave or the lowest location (closest to the chambers 20) that the water rests when waves are being generated.

Exemplary embodiments described herein may include a lagoon or trough in which the pool floor reaches a highest position in the beaching area 185. The floor may thereafter recede or become lower such that water may be captured in a second pool area 183. The second pool area 183 may be shallow to create a wading pool or lagoon or may be deeper to create a trough or trench to direct water. The second pool area 183 may be used to capture water from the pool area 181 from waves 182 traversing the beaching area 185 and into the second pool area 183. This water capture may reduce the water returning to the pool area 181 and reduce adverse impacts from currents generated from the receding water.

The highest point of the beaching area before transitioning into the second pool area 183 may occur between a low water line and high water line of pool area 181, adjacent the low water line, at the low water line, or combinations thereof along the beaching area. For example, as illustrated, the highest point of the beaching area on the lateral outer edges of the beaching area 185 may be adjacent or within the low water line, such that the pool area 181 and the second pool area 183 may be in fluid communication regardless of the generation of a wave. The highest point of the beaching area toward the central area of the pool may be outside or at the high water line 184 such that the pool area 181 and second pool area 183 are separated by a gap 186 of an elevated floor such that the pools are not in fluid communication through the gap (but may be through other areas along the beaching area). The highest point of the beaching area may also be between the low water line and high water later, such that the pool area 181 and second pool area 183 are in fluid communication along the portion of the beach area only when a wave is generated and propagates through the beaching area. In this case, the water is captured as it is pushed up on the shore and does not return to the pool area 181 directly from the exit location.

As illustrated in FIG. 12, a combination of the relative locations and separation of the first pool area 181 form the second pool area 183 may be used. As illustrated, the first and second pool area may be in fluid communication during the generation of a wave along a length of the beaching area from an outside lateral edge toward the middle of the beaching area. The highest elevation of the pool floor between the first pool area 181 and the second pool area 183 may be approximately equal to the low water line or between the low water line and the high water line. Toward a center of the pool area the first pool area 181 may be separated with a gap 186 from the second pool area 183 such that the highest elevation of the pool floor between the first pool area 181 and the second pool area 183 along this gap is approximately equal to or higher than the high water line.

As illustrated in FIG. 12, additional pool features may also be included. For example, a lagoon 187 may be in fluid communication with second pool area 183 and first pool area 181. The lagoon 187 may be a shallow area to permit the water to flow from the second pool area 183 back into the first pool area 181. As illustrated by the arrows, the water may be controlled through the second pool area 183 such that water is captured from the first pool area as waves are generated. The water then travels along the second pool area 183 to be recirculated back into the first pool area at a desired location. As illustrated in FIG. 12, the desired location may be in the central area of the beaching area. As illustrated, in FIG. 14, the water may be removed from the second pool area and reintroduced anywhere within the system. As illustrated in FIG. 15, the water may be moved along the second pool area to be reintroduced in other areas of the pool such as at the lateral sides of the first pool area.

Exemplary embodiments of the wave generating device may include a beach area 188 adjacent the second pool area or lagoon or other water feature in which water may not reach and spectators may congregate. Other viewing areas 189 may be provided along other sides of the wave generating device, such as at lateral sides of the pool area 181.

Exemplary embodiments may therefore include a pool configuration in which wave energy flushes over a floor height corresponding to a desired water level (such as the low water line) into a second pool area. The second pool area may be of a deeper lagoon or trough. The second pool area(s) may be configured to absorb and dissipate the currents from the main pool or the pool used to create the waves. In an exemplary embodiment, the main pool and the secondary pool(s) may be fluidly connected through deep water channel, thereby maintaining the water levels of the main pool and secondary pool(s) at an equivalent height with no surge tanks or pumps required.

Figure 13:
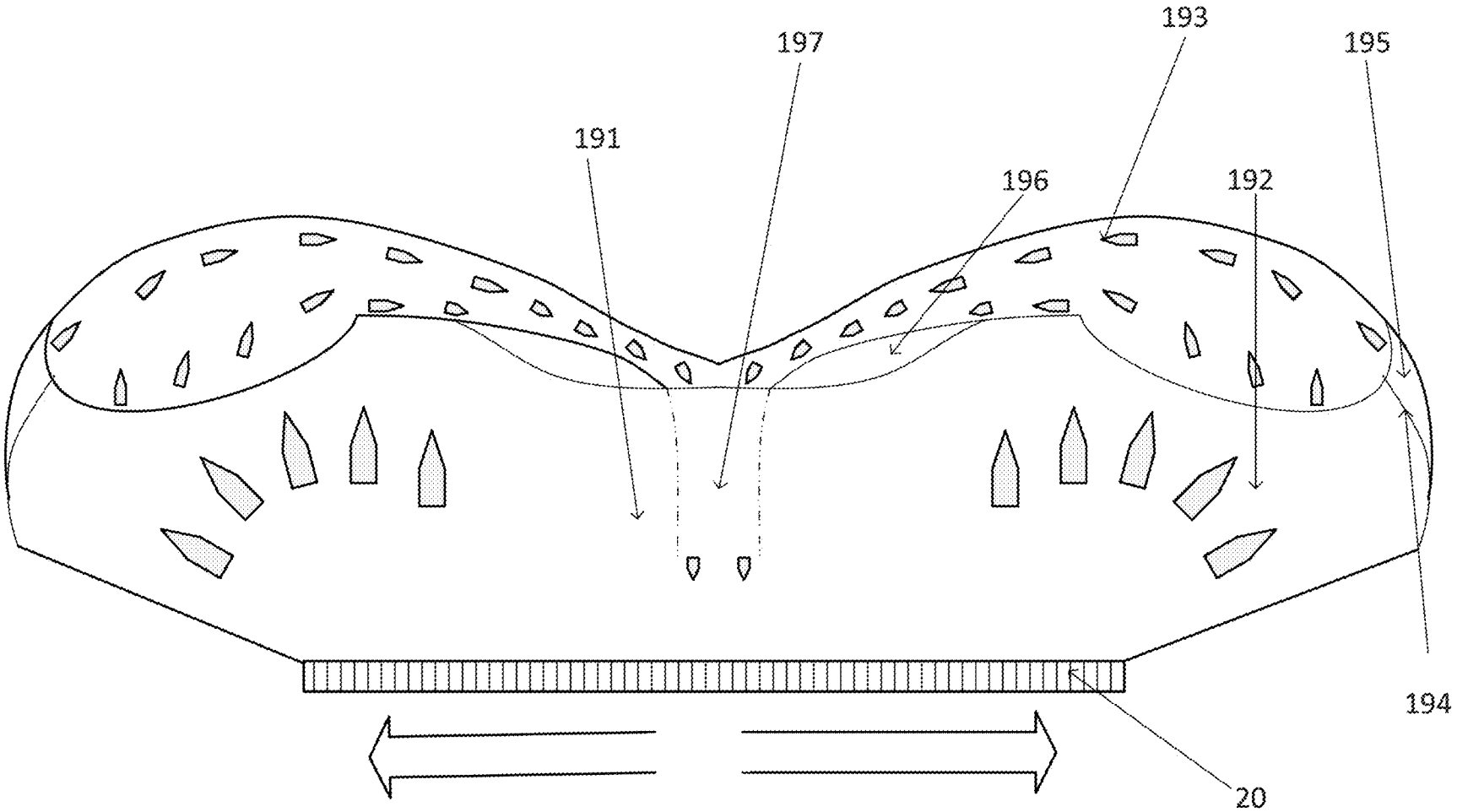

FIG. 13 illustrates an alternative pool configuration having a first pool area 191 and a second pool area 193 to dissipate energy created from wave 192. The main or first pool area 191 may include a low water line and a high water line as waves are generated and dissipate along the beaching area 195. A desired water line 194 may be selected in which the first pool area 191 and a second pool area 193 may be in fluid communication. This desired water line 194 may be at the low water line, below the low water line, or between the low water line and high water line, or combinations thereof along a length of the beaching area. This desired water line 194 may correspond to the highest elevation of a pool floor at a point between the first pool area and the second pool area. Similar to the illustration of FIG. 12, a gap 196 may be formed between a portion of the first pool area 191 and the second pool area 193 along a length of the beaching area.

The embodiments of FIG. 13 may create a larger lagoon area at the beaching areas adjacent the lateral sides of the main pool 191 at opposing ends of the beaching area 195. The second pool areas may therefore comprise a slope that extends into the main pool area 191. The second pool areas 193 may then create a channel toward a center of the wave generating device 20 to re-enter the main pool area at a location in the middle of the beaching area.

In an exemplary embodiment, the wave generation device may include a deep water return channel 197. The deep water return channel 197 may fluidly couple one or more of the second pool(s) 193 with the main pool 191 away from the beaching area 195 of the main pool. As illustrated, the deep water return channel 197 goes under the beaching area 195 of the first pool 191 to fluidly couple to a floor of the first pool 191 adjacent the chambers or closer to the chambers 20 than the beaching area.

Exemplary embodiments may therefore include wave generation devices having a first pool and one or more second pools. The first pool and one or more second pools may be configured such that wave energy from the first pool flushes over a desired water line or level and into the one or more second pools. As illustrated, two second pools may be used on opposing ends of the beaching area of the first pool. The second pool area(s) may thereafter deepen and provide water levels and return channels that may absorb and dissipate the water currents from the main pool. In an exemplary embodiment, the water may be returned back into the first pool.

Figure 14:
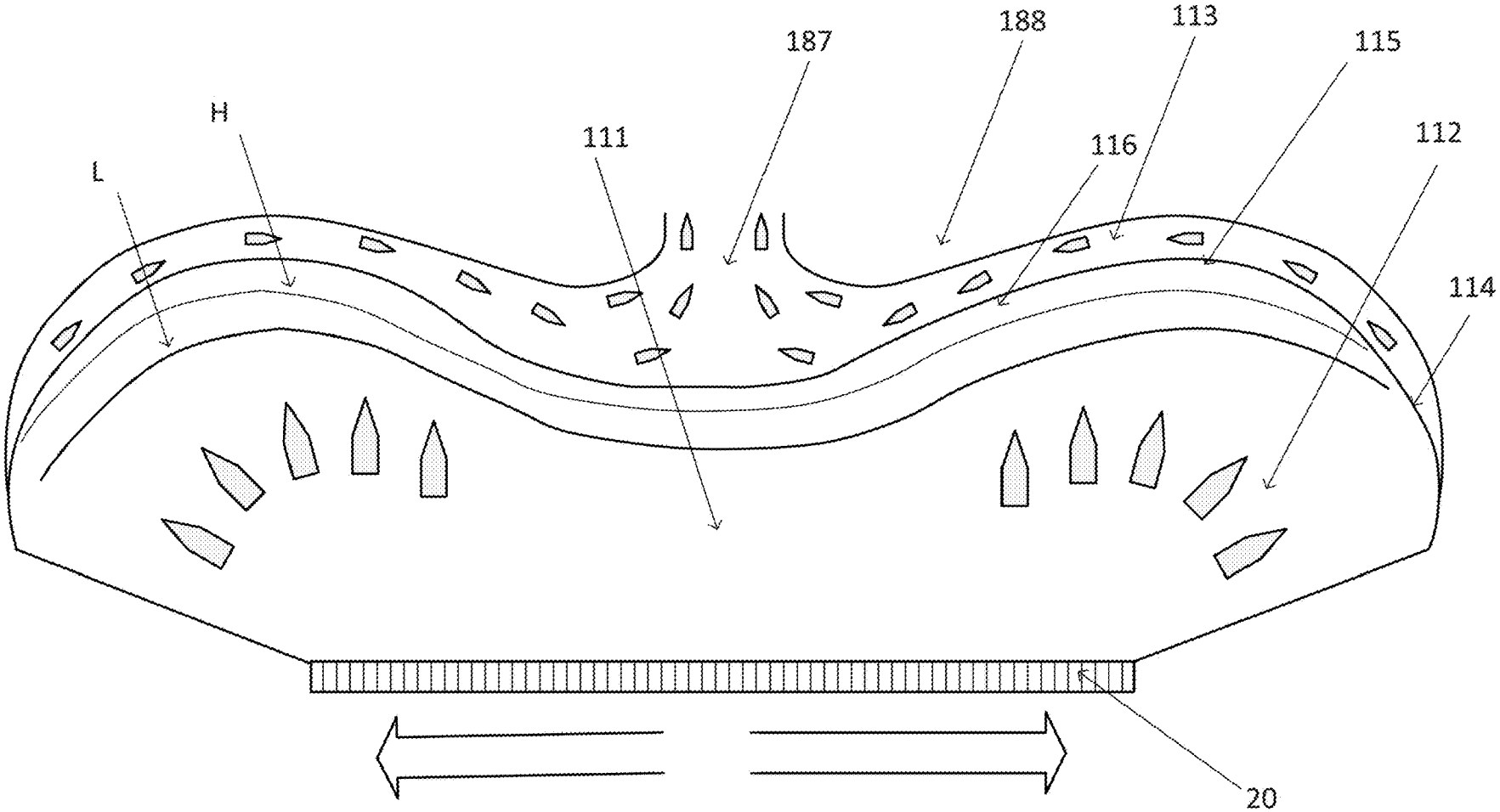
Figure 15:
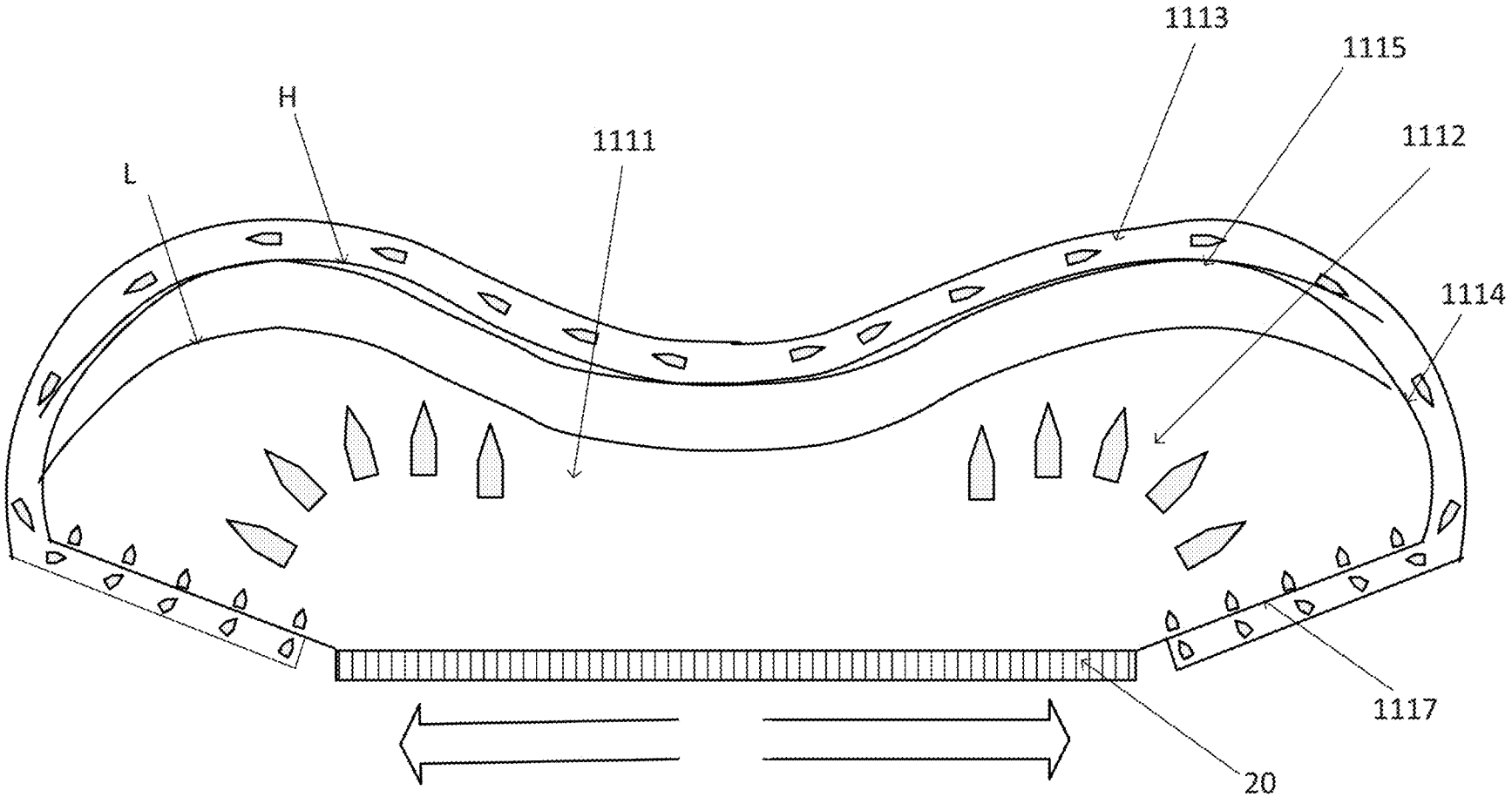

FIG. 14 illustrates an alternative pool configuration having a first pool area 111 and a second pool area 113 to dissipate energy created from wave 112. The main or first pool area 111 may include a low water line (L) and a high water line (H) as waves are generated and dissipate along the beaching area 115. A desired water line 114 may be selected in which the first pool area 111 and a second pool area 113 may be in fluid communication. This desired water line 114 may be at the low water line, below the low water line, or between the low water line and high water line, or combinations thereof along a length of the beaching area. This desired water line 114 may correspond to the highest elevation of a pool floor at a point between the first pool area and the second pool area. Similar to the illustration of FIG. 9, a gap 116 may be formed between a portion of the first pool area 111 and the second pool area 113 along a length of the beaching area.

In the exemplary embodiment of FIG. 14, the water from the one or more second pool(s) may be removed from the wave generating device 20 or main pool 111. In this case, the water may be directed to a sump tank or other water feature, such as a lazy river or wading pool. In an exemplary embodiment, this other body of water may have a lower static water level to allow water to drain from the one or more second pools or the channels created thereby and into this other body of water. In an exemplary embodiment, the water from this other body of water may be pumped back into the main pool 111 or into the chambers 20. Flow rates and pump inlet locations may vary depending on the pool configurations or other body of water feature.

In an exemplary embodiment, the second pool area(s) 113 may be covered. The second pool area(s) is comprised of deeper channels that can capture the water as it overflows from the main pool 111 during a wave. The second pool area(s) may be covered by a perforated flooring such that water may pass there through, but patrons may walk over the top of the second pool area(s). Therefore, all or portions of the second pool area(s) may not be used as part of the activity area of the water attraction. Instead, the second pool area(s) may be positioned underneath the beaching area.

Exemplary embodiments provided herein include a wave generating device in which wave energy may be flushed over a static water level divider and into one or more second pool areas. Currents may therefore be drained away to a sump or other water feature at a lower static water level than the main pool. Water may thereafter be pumped from the sump or feature back into the pool to maintain operational water levels.

FIG. 15 illustrates an alternative pool configuration having a first pool area 1111 and a second pool area 1113 to dissipate energy created from wave 1112. The main or first pool area 1111 may include a low water line (L) and a high water line (H) as waves are generated and dissipate along the beaching area 1115. A desired water line 1114 may be selected in which the first pool area 1111 and a second pool area 1113 may be in fluid communication. This desired water line 1114 may be at the low water line, below the low water line, or between the low water line and high water line, or combinations thereof along a length of the beaching area. This desired water line 1114 may correspond to the highest elevation of a pool floor at a point between the first pool area and the second pool area. In this exemplary embodiment, the desired water line 1114 is at or below the low water line for a portion of the length of the beaching area and is approximately equal to the high water line along another portion of the length of the beaching area. In an exemplary embodiment, the desired water line may be at the low water line or between the low water line and the high water line along an entire length of the beaching area such that a gap is not created between the first and second pools or a gap is only temporarily created between the first and second pools during the water generation.

As illustrated by the arrows of FIG. 15, the water flow in the one or more second pools may be toward opposing lateral ends of the beaching area to the lateral sides of the main pool 1111. The second pool(s) 1113 may extend along lateral sides of the pool 1111 and may be in fluid communication with the first pool 1111. In an exemplary embodiment, the bottom of the main pool 1111, either along a lower edge of the lateral side wall or through a floor of the pool 1111, may include grills or apertures to fluidly couple to the second pool(s) 1113. Water may be returned to the first pool 1111 through the lower portion or bottom of the first pool 1111.

Exemplary embodiments described herein may include a wave generating device in which wave energy may be flushed over a divider having a height at a desired water level and into a secondary pool. The secondary pool may comprise a channel having a covering. The covering may permit water to traverse the covering but may not permit a person or body part to traverse the covering. In an exemplary embodiment, the covering may conceal the channel within a beaching area of the first pool. In an exemplary embodiment, currents may be diminished in the channel. The channel and the first pool may be fluidly connected through openings at the pool bottom allowing the two bodies of water to maintain an equal water level without pumping. Users and patrons may also traverse over the covering of the channel.

Exemplary configurations of systems and methods to dissipate wave energy and control currents within a main pool are provided herein. Illustrative combinations are provided by way of example only. Any exemplary feature may be used with any combination of other exemplary features. For example, any representative example may include shallow open pools that may act as wading pools or lagoons as second pool(s). Any representative example may include channels having coverings such that the second pool does not create an activity section. Any representative example may include a deep water return channel for coupling the second pool to a floor of the first pool. Any representative example may include one or more pumps to assist in fluid flow and moving water in a desired direction. Any representative example may have the first and second pool(s) in fluid communication during the entirety of a wave generation. Any representative example may have any configuration of the desired water line separating the top of the first pool from the top of the second pool to permit water from the first pool to overflow over the desired water line and into the second pool(s). For example, any representative example may position the desired water line below the low water line, approximately equal to the low water line, between the low water line and the high water line, or above the high water line, or any combination thereof along a length of the length between the first pool and one or more second pools.

Exemplary embodiments described herein may include a pool wave generator, having a pool area, and a plurality of chambers on one side of the pool area for releasing water into the pool area to generate a wave in the pool area. The pool area may include a first linear wall and the plurality of chambers are configured to release water into the pool area along an entire length of the first linear wall. The pool area may also include two lateral side walls extending from terminal ends of the first linear wall at an oblique angle.

Exemplary embodiments may also include a pool wave generator having a pool area and any method of generating a wave to propagate across the pool area. The pool wave generator may also include one or more second pool areas. The first pool area and the second pool area may be separated by a divider having a height at a desired water level. The height of the divider may change along a length of the divider between the first pool area and the second pool area. The height of the divider may be at a low water height of the pool area during wave generation, at a resting water height of the pool area when waves are not being generated, at or above a low water height of the pool area during wave generation and below a high water height of the pool area during wave generation, and combinations thereof.

The second pool(s) may be positioned across the pool area from the chambers. The second pool(s) may be configured to create a channel for water to travel transverse across a length of the pool area and minimize an amount of water returned into the pool at an exit location of the water leaving the pool area after a wave. The second pool may be positioned to receive water exiting the pool area during a wave to minimize the direct return of the water back into the pool area.

The second pool may be in fluid communication with the first pool area through a deep channel positioned under a floor of the first pool area.

Water received in the second pool may be diverted into another water structure. For example, the other water structure may be a separate water activity area, such as a wading pool, a pool, a lazy river, or combinations thereof.

The second pool may comprise a channel. The channel may be configured to extend around a lateral side of the pool area. The channel may be configured to reintroduce water from the channel into the pool area at a bottom of the pool area.

The second pool may be covered, wherein the cover includes perforations to permit fluid to flow there through but prevent a body part from traversing the covering.

Figure 16:
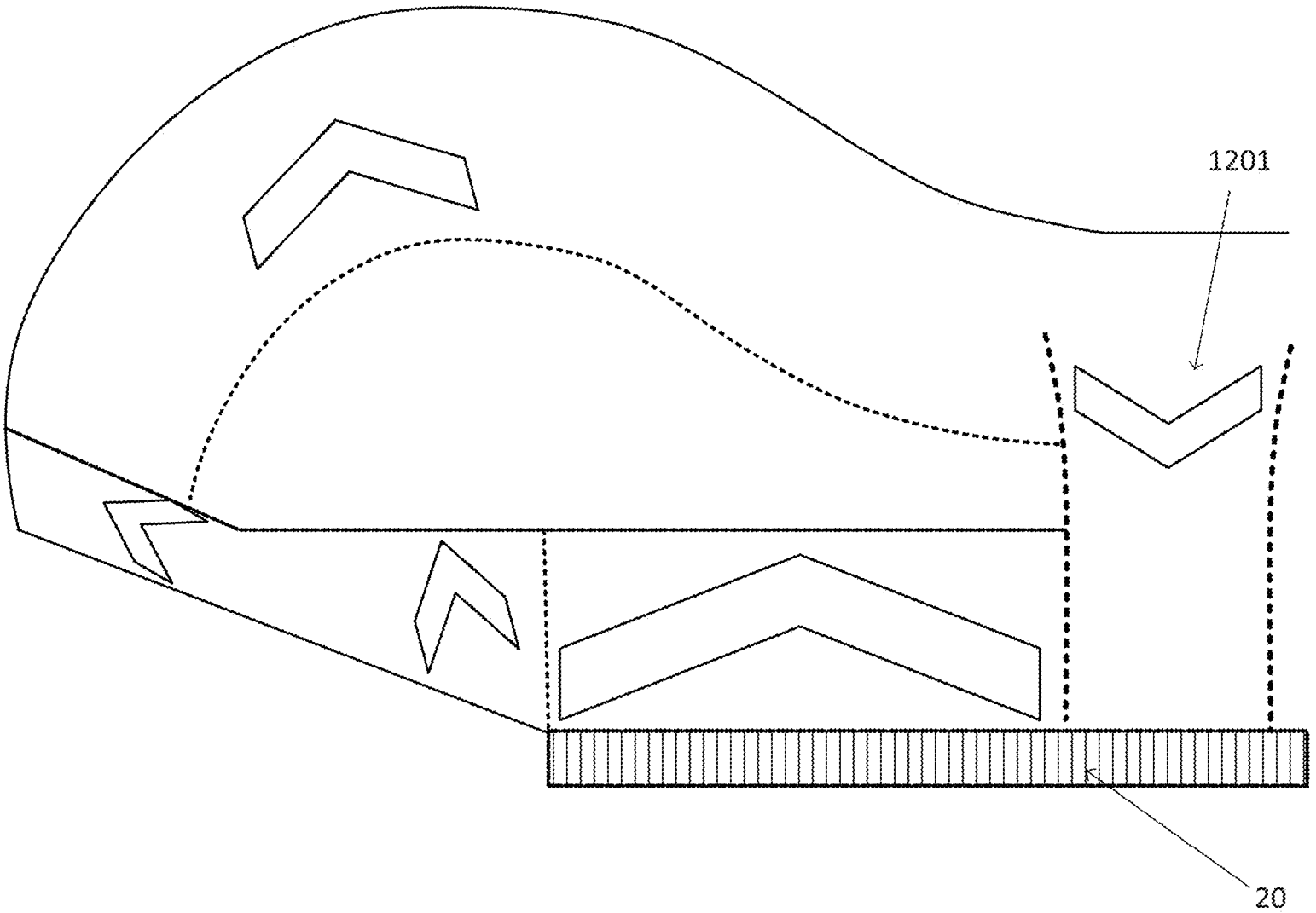
FIG. 16 illustrates an exemplary portion of a wave generator according to embodiments described herein for managing currents and water flow.

FIG. 16 illustrates part of an exemplary floor bottom similar to FIG. 4. As illustrated, the pool floor may include a return channel 1201 at the center of the pool. The return channel may be a floor contour to facilitate the current movements from the first or second pools as described herein. For example, an exemplary floor may include a continuous tapered area to permit smooth transition of the return water back into the pool. The return channel 1201 may facilitate a phenomenon similar to an eddy current. All or a portion of the return channel 1201 may be at a lower elevation relative to the pool floor on opposing lateral sides of the return channel at one or more locations or lengths.

Figure 17:
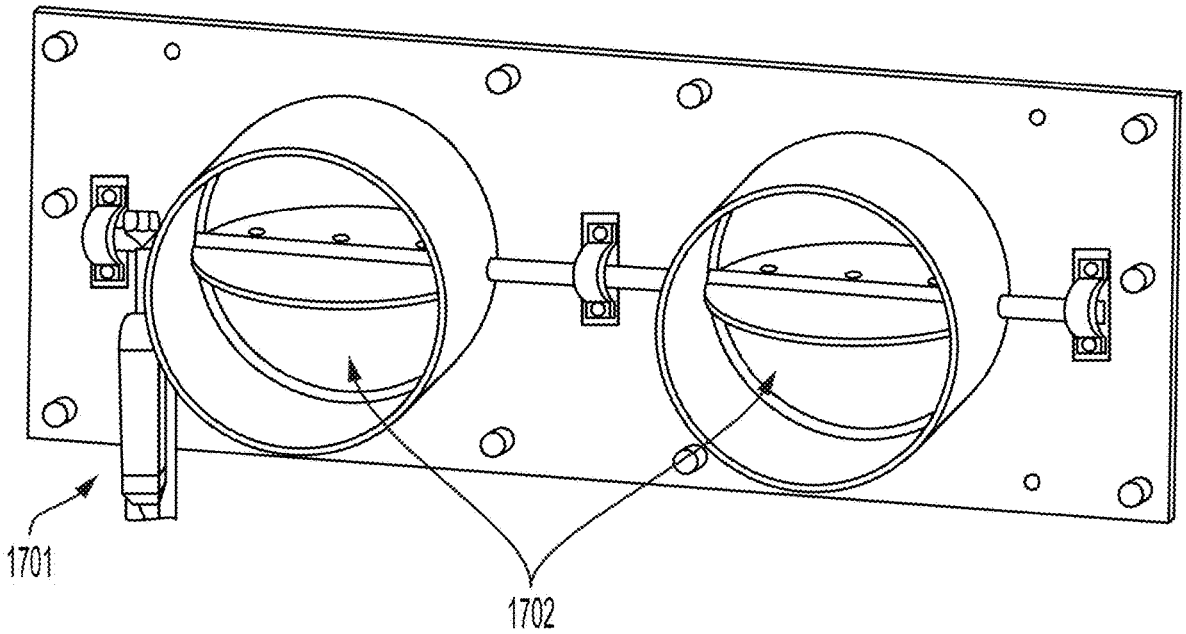
FIG. 17 illustrates an exemplary valve set.

FIG. 17 illustrates a valve set including one or more valves 1702 equipped with a position-controlled actuators 1701 which allows the valves to open to 0 degree (fully opened) or 90 degrees (fully closed) and anywhere in between where the position of the valves is given by a main controller signal to the actuator controller. The reaction of the actuator in response to a signal can be tuned through the actuator controller. As shown in FIG. 17, the valves 1702 are fully open. As described above with respect to FIGS. 2A-2C and 6-9, the ability to selectively open and close the valves provides additional control over the waves created according to exemplary embodiments of this disclosure.

Figure 18:
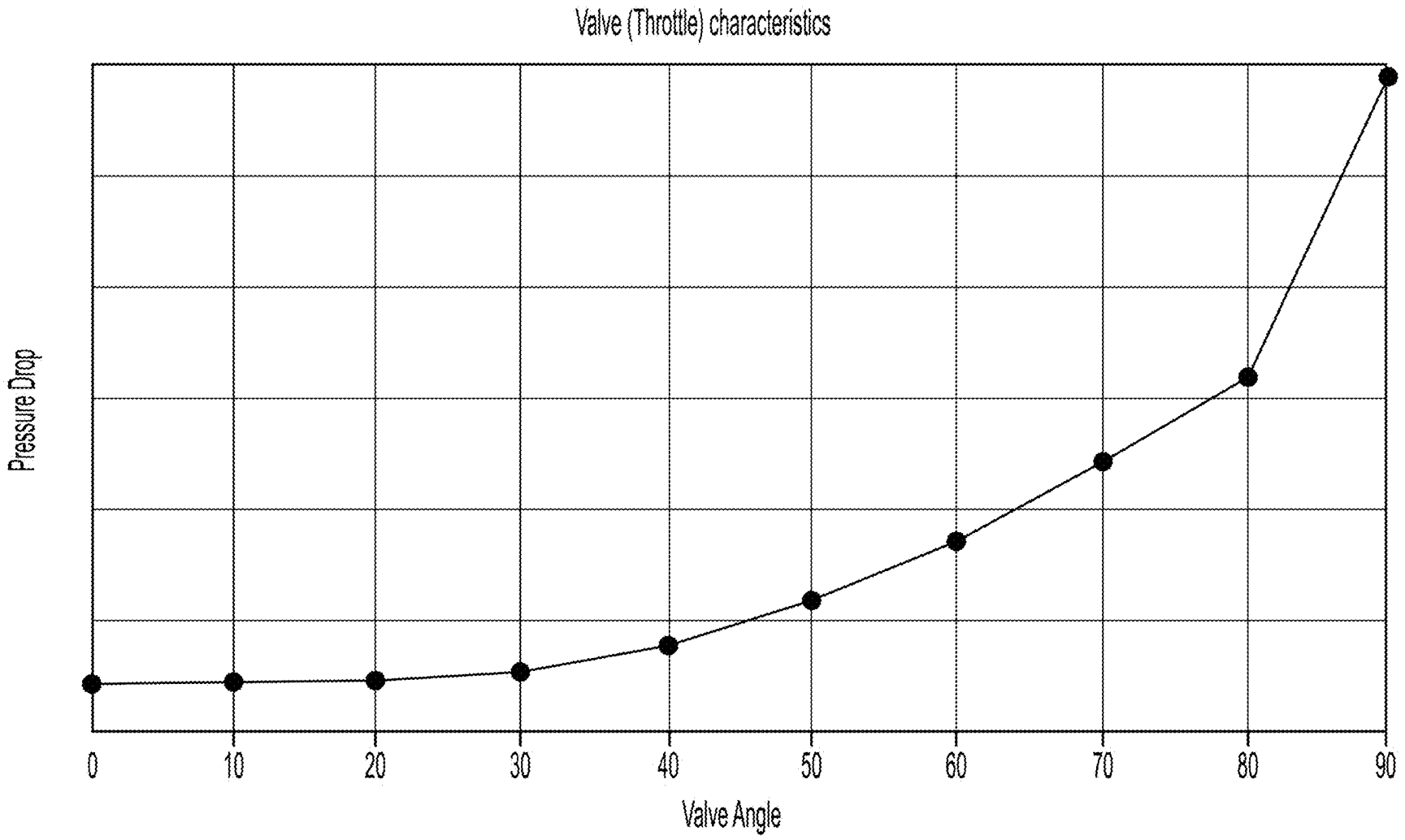
FIG. 18 illustrates typical throttle characteristics for the valves.

FIG. 18 illustrates typical throttle characteristics, showing the pressure drop through the valve or throttle increase with opening increasing. By controlling the opening of the valves, one can control the pressure drop through the valves, and the amount of air transmitted through the valves.

Figure 19:
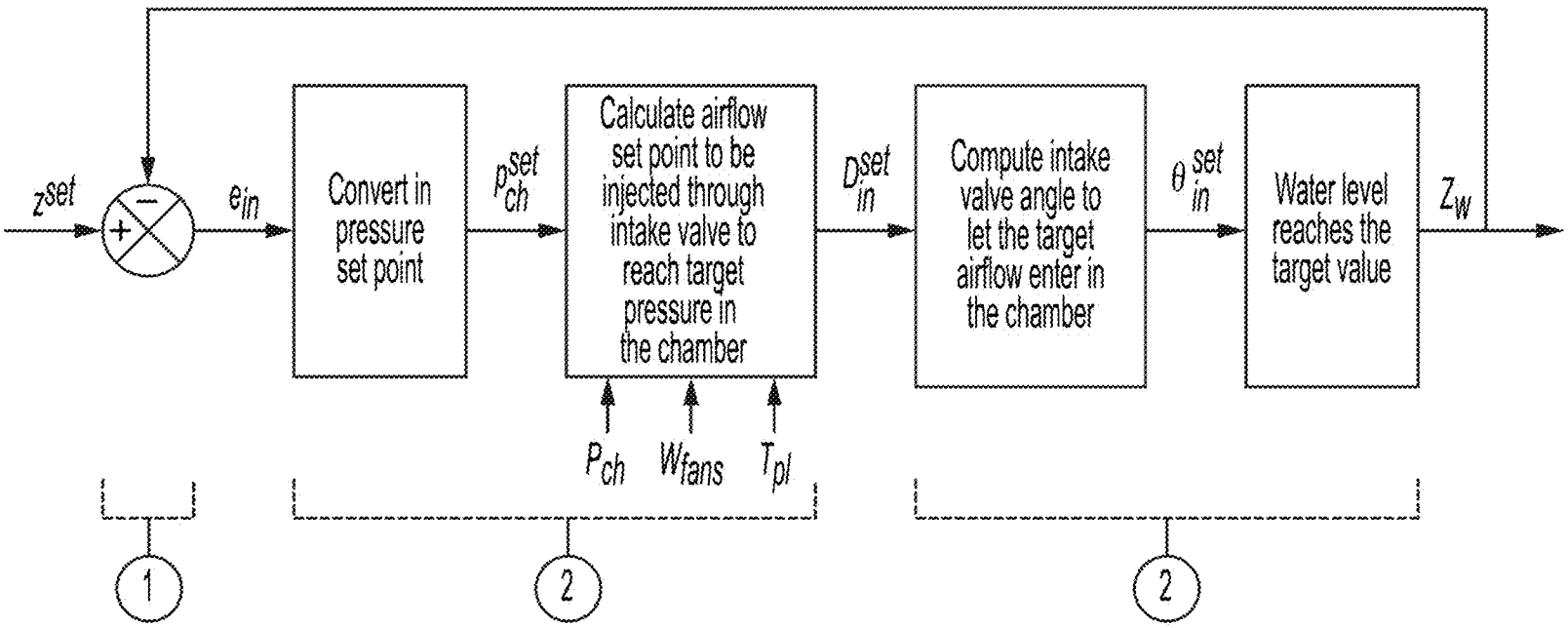
FIG. 19 is a block diagram describing the calculation of the angle of the valve required to meet the target water height.

FIG. 19 is a block diagram that describes the calculation of the angle of the valve required to meet the target water height. The controller method to calculate the valve opening based on water height target and measure of current water height in the chamber, pressure in the chambers, temperature in the plenum, power drawn by the fan motors, and the temperature and humidity of the mechanical room, using well-known laws of fluid dynamics is shown. $Z^{set}$ is the target height received from the user interface. $Z_w$ is the actual water height measured by the sensors. Error is indicated by $e_{in}$, which is the difference between $Z^{set}$ and $Z_w$. The error will calculate an angle needed to reach the target, and then sends a signal to the actuator to open the valves to the appropriate degree. The process repeats as the system constantly measuring, recalculates, and makes adjustments as necessary.

FIGS. 20A-20D illustrate the position of the valves and water level of the system and method at each of the points, 1, 2, and 3, indicated in FIG. 19. At the end of step 3, the system repeats, as described above. Although certain sensors are shown and described in these drawings, additional or alternative sensors may be used, as described above. Similar to the chamber of FIG. 6, an exhaust valve 2023 and intake valve 2024 are provided. The chamber 2020 may be in fluid communication with a plenum 2006. The passage 2066 communicates between the chamber 2020 and the pool. A controller 2050 is provided that is part of a control loop. The chamber 2020 can also include a chamber water level sensor

Figure 20A:
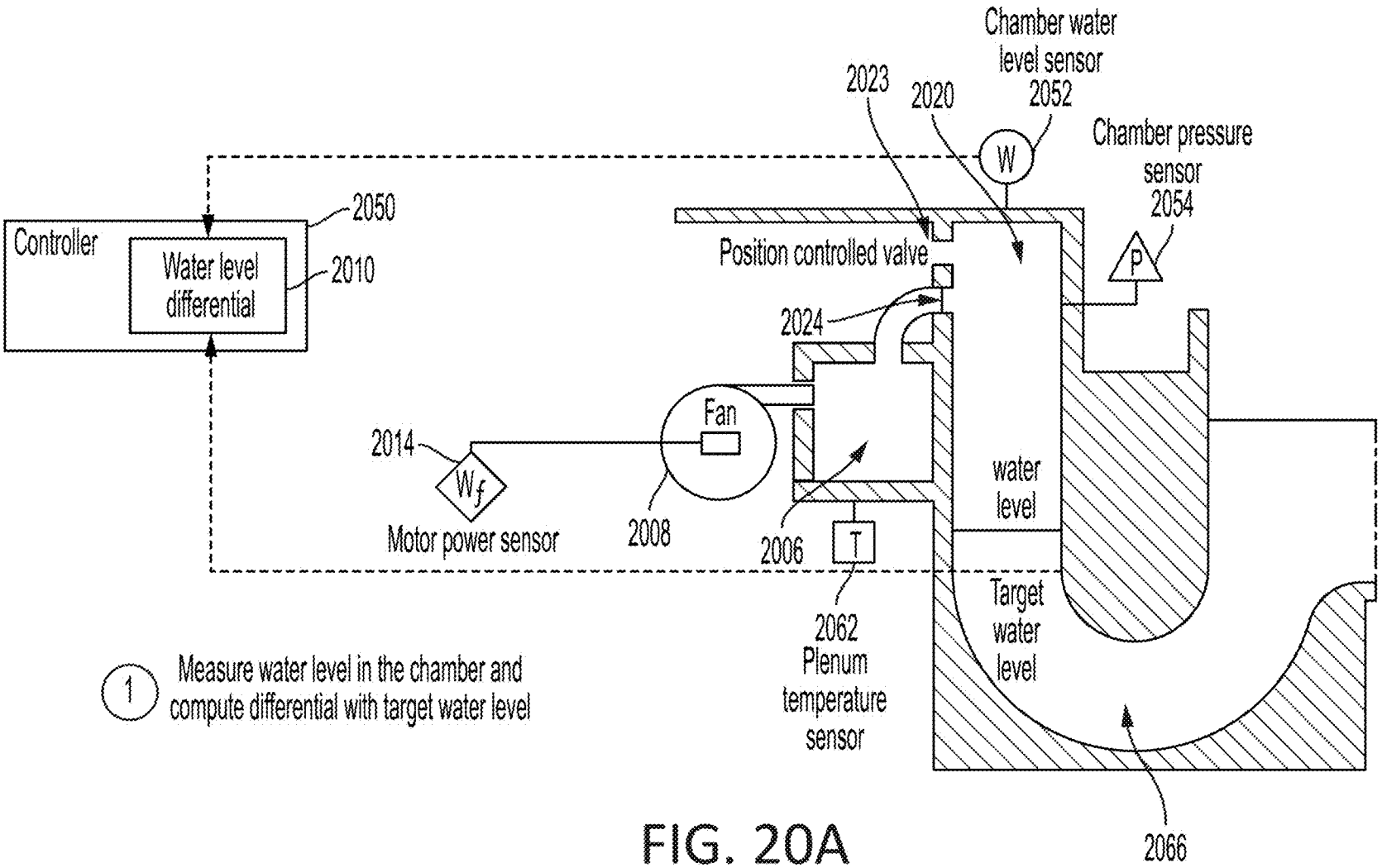
FIGS. 20A, 20B, 20C, and 20D illustrate aspects of the valves and water levels of the system and method corresponding to FIG. 19.
Figure 20B:
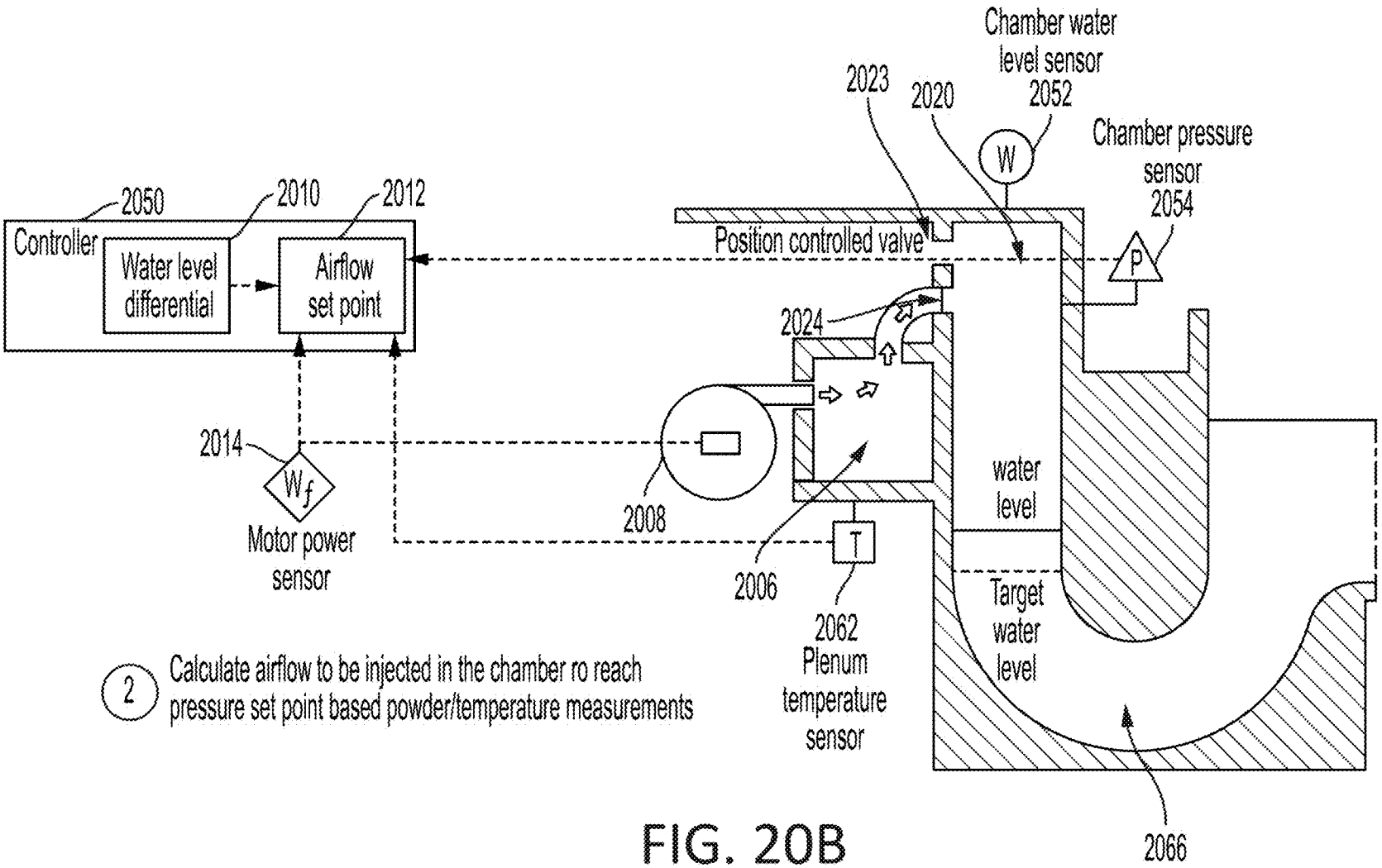
Figure 20C:
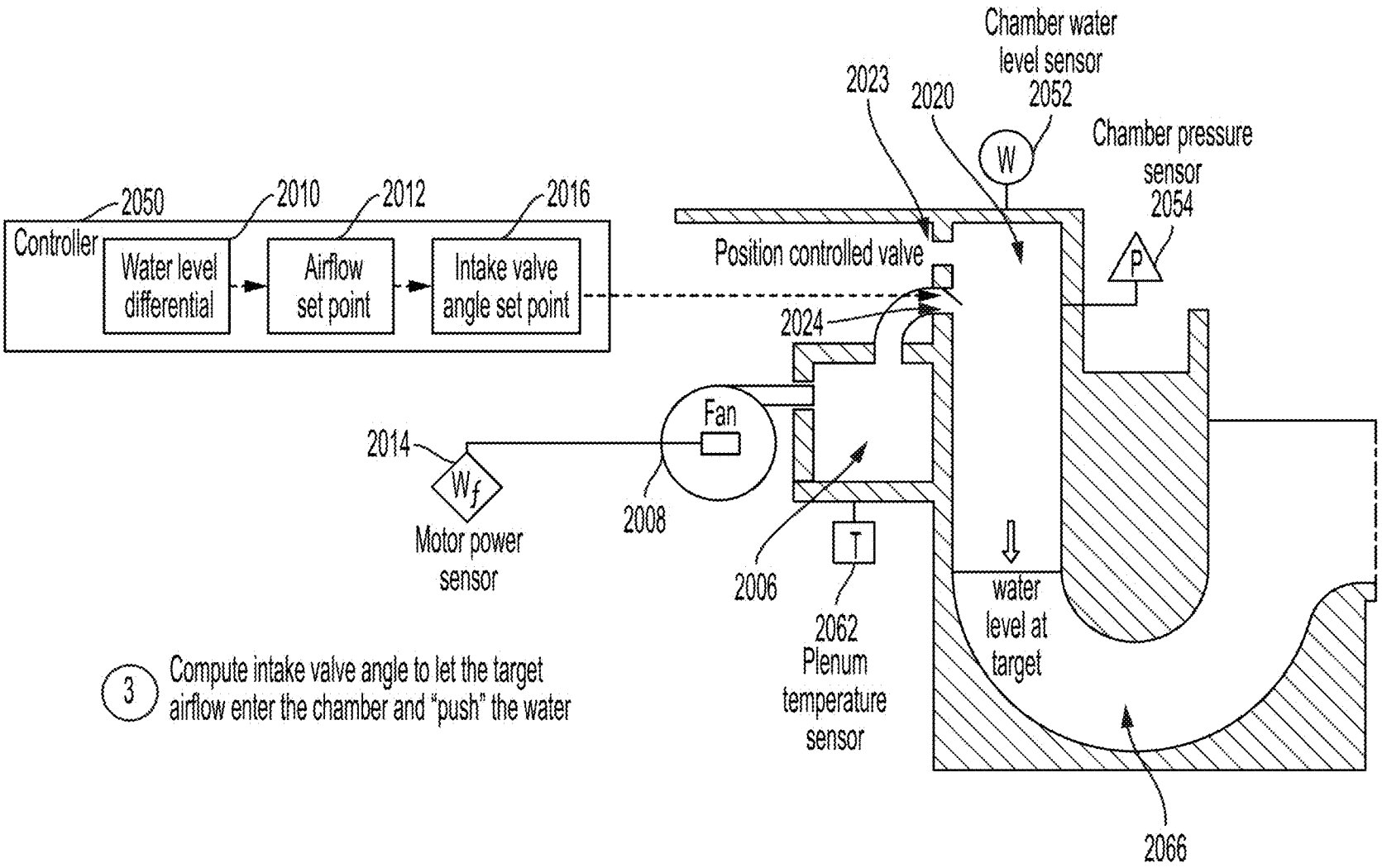
Figure 20D:
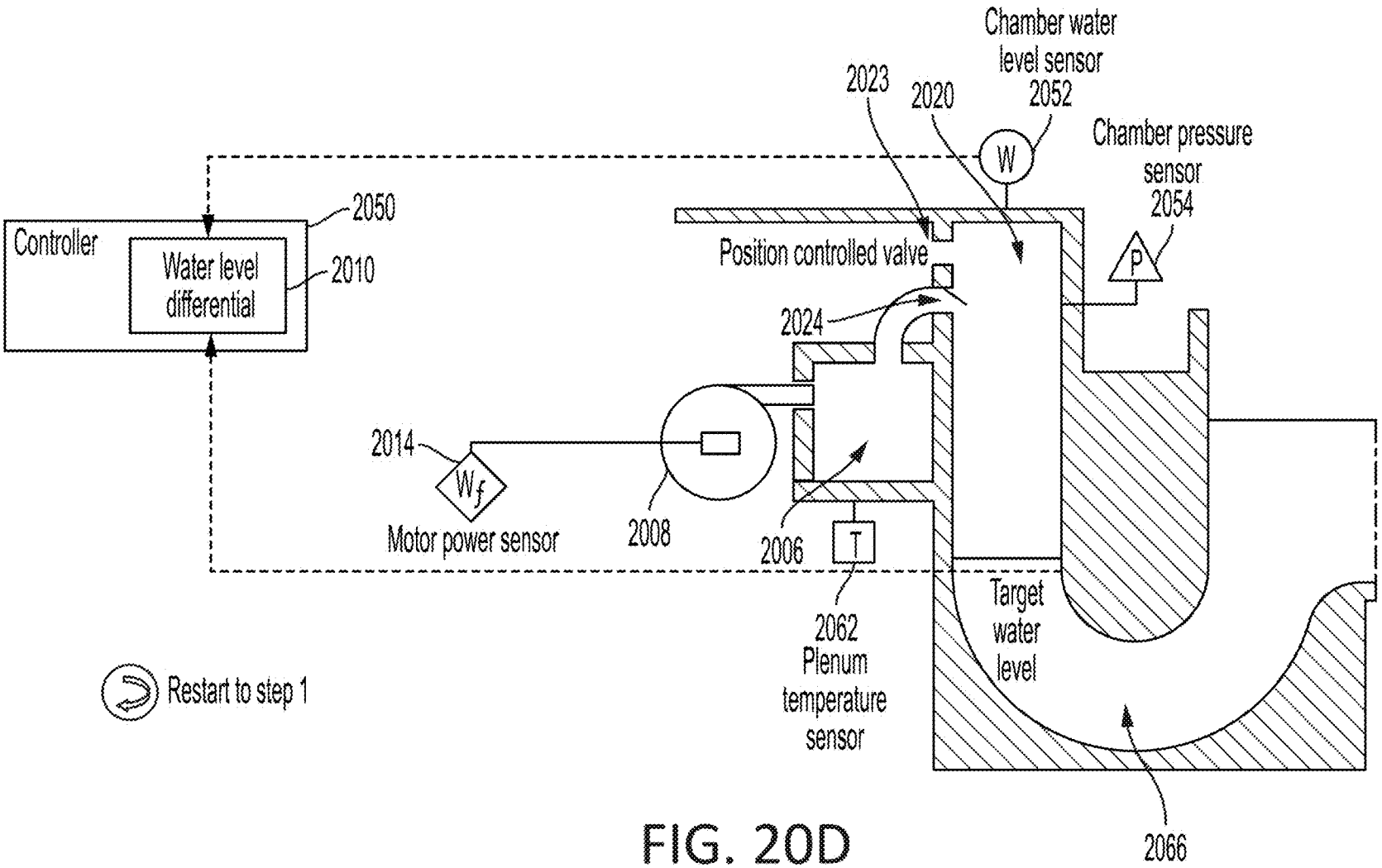

2052, a chamber pressure sensor 2054, a plenum temperature sensor 2062, a fan 2008 and a motor power sensor 2014. The controller 2050 in FIG. 20A has a water level differential sensor 2010. FIG. 20B also includes an airflow set point 2012 in communication with a motor power sensor 2014. The controller 2050 in FIG. 20C also includes an intake valve angle set point 2016. As depicted in FIG. 20C, the intake valve angle is computed and the intake valve 2024 is opened to the chosen angle to allow air to enter the chamber and "push" the water level to the target height, thereby utilizing the variable valves to maintain optimal conditions within the chamber for creating a desired wave profile. Likewise, as shown in FIG. 17 the exhaust valve 2023 is also a position-controlled valve that may be opened to a desired angle of fully open, fully closed, or an angle between fully open and fully closed in order to maintain the desired wave height and create the desired wave profile.

Figure 21:
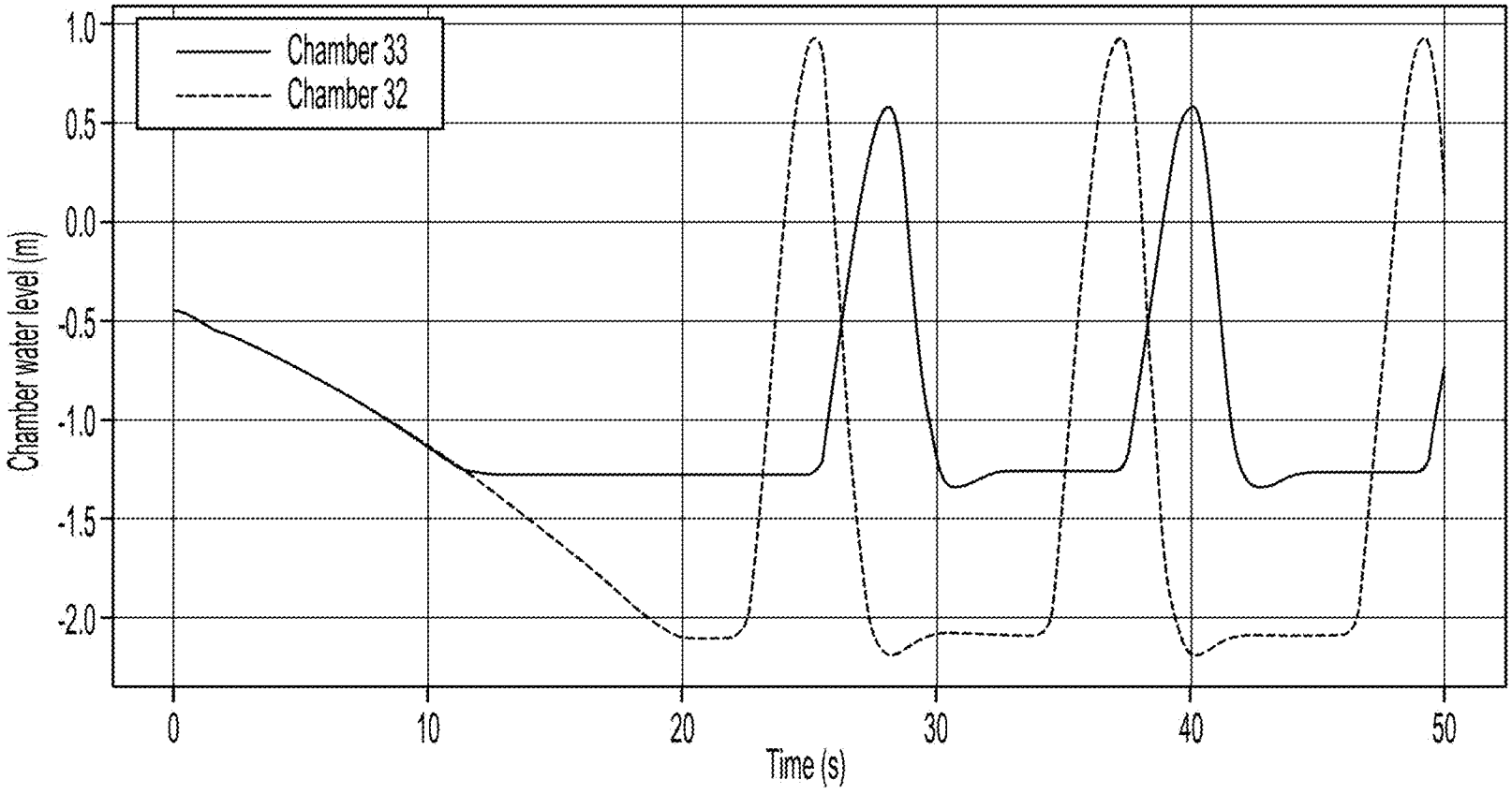
FIG. 21 is a chart representing water height evolution in different chambers.

FIG. 21 illustrates the water height evolution in different chambers. As described above, the pool wave generator and pool may be configured to produce two waves in the same pool. For example, one wave moving generally toward the left side of the pool, while a second wave moves generally toward the right side of the pool. The present embodiment allows the ability to have different water height targets in the chambers allowing the chambers to create different size waves at the same time. For example, a more skilled rider might desire a larger wave, while a novice rider in the same pool may desire a smaller wave. FIG. 21 depicts this scenario, whereby the first wave generates a larger amplitude, and the second wave is comparatively smaller. This allows the pool to host different skill level groups at the same time and to reduce the peak power consumption.

Figure 22:
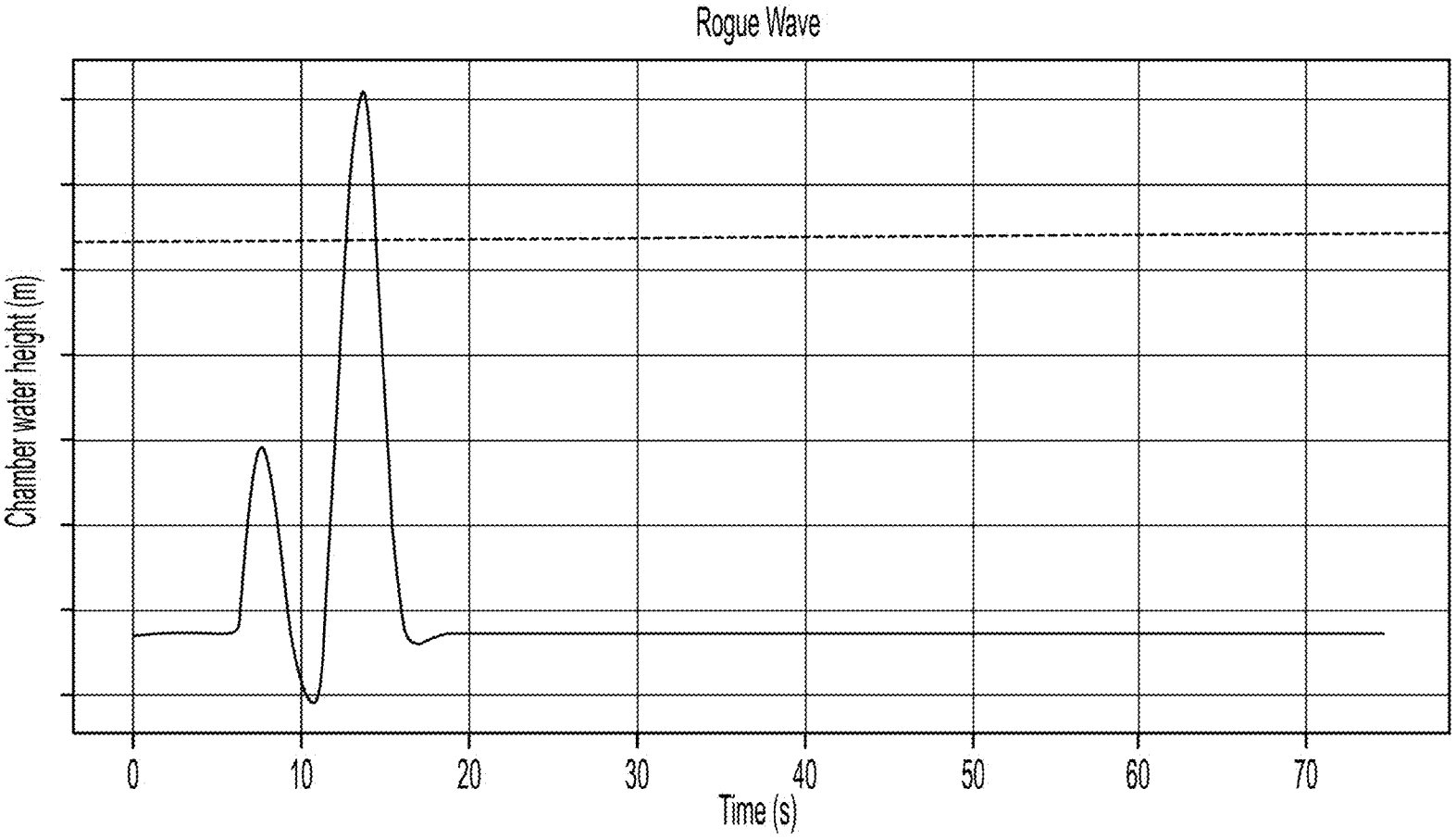
FIG. 22 is a chart representing water height in a method of exceeding the normal maximum wave amplitude.

FIG. 22 illustrates a method of creating a wave with a maximum amplitude that is greater than normally possible with a given equipment setup. In this method, the water height elevation in the chamber is controlled, allowing the system to create a first, small amplitude wave (excitation) to set the water in motion to create a bigger wave after. As shown in FIG. 22, the dashed line indicates the maximum wave amplitude for a given system. The biggest wave height can be boosted by 25% compared to the uncontrolled method, resulting in a wave that exceeds the normal maximum amplitude. As also described above, when the valves are used in this configuration, such that the valves are configured to transition between fully closed and fully open states, the air within the chamber can act as a spring. As the water within the chamber reaches a maximum or minimum height, the water level may bounce as the air is compressed and released, creating an oscillating wave surface.

Although various embodiments have been fully described with reference to the accompanying drawings, it is to be noted that various changes and modifications will become apparent to those skilled in the art. Such changes and modifications are to be understood as being included within the scope of embodiments of this disclosure as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

When used in this specification and claims, the terms "comprises" and "comprising" and variations thereof mean that the specified features, steps or integers are included. The terms are not to be interpreted to exclude the presence of other features, steps or components. Likewise, the words "and" and "or" should not be interpreted to exclude the presence of other features, steps or components, unless otherwise specified.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

That which is claimed is:

1. A chamber assembly for generating waves, the chamber assembly comprising:

a chamber for releasing water to generate a wave, the chamber comprising a sensor and an ingress valve; and a control system connected to the sensor and the ingress valve, wherein the control system receives input from the sensor to enable the control system to selectively control the position of the ingress valve to thereby permit air into the chamber to effect the release of water from the chamber.

2. The chamber assembly of claim 1, wherein the control system sends a signal to the ingress valve to open the ingress valve to a first preset valve angle when the water in the chamber reaches a first water level, and to thereafter open the ingress valve to a second preset valve angle when the water in the chamber reaches a second water level and thereby push water out of the chamber.

3. The chamber assembly of claim 2, wherein the first water level is different than the second water level.

4. The chamber assembly of claim 1, wherein the sensor comprises one of a pressure sensor, a water height sensor, or a temperature sensor.

5. The chamber assembly of claim 4, wherein the sensor comprises the water height sensor to determine the height of the water in the chamber.

6. The chamber assembly of claim 5, wherein the control system comprises a controller to set an ingress valve opening percentage, wherein the ingress valve opening percentage is related to a difference between the height of the water measured by the water height sensor and a set height point.

7. The chamber assembly of claim 1, wherein the control system comprises a user interface for receiving desired water height profile characteristics for the chamber from a user.

8. The chamber assembly of claim 7, wherein the control system selectively controls the position of the ingress valve between to create the desired water height profile characteristics received from the user.

9. The chamber assembly of claim 1, wherein the ingress valve introduces pressurized air into the chamber.

10. The chamber assembly of claim 9, wherein:

the chamber further comprises a vent valve;

the vent valve releases the pressurized air from the chamber; and the control system is further configured to selectively control the vent valve.

11. The chamber assembly of claim 10, wherein:

in a first state, the vent valve is fully closed and the ingress valve is at least partially open to pressurize the chamber and reduce a water level in the chamber; and in a second state, the ingress valve is fully closed and the vent valve is at least partially open closed to evacuate the air from the chamber and increase the water level in the chamber.

12. The chamber assembly of claim 10, wherein, in a third state, the vent valve is at least partially open and the ingress valve is at least partially closed.

13. The chamber assembly of claim 1, wherein:

the chamber is a first chamber of a plurality of chambers;

each of the chambers comprises a one of the sensors and a one of the ingress valves; and the control system is connected to each of the sensors and each of the ingress valves.

14. The chamber assembly of claim 13, wherein the control system sends a signal to each ingress valve to open the ingress valve to a first preset valve angle when the water in the corresponding chamber reaches a first water level, and to thereafter open the ingress valve to a second preset valve angle when the water in the corresponding chamber reaches a second water level and thereby push water out of the corresponding chamber.

15. The chamber assembly of claim 14, wherein at least one of the plurality of chambers reaches the second water level at a different time than each other chamber of the plurality of chambers.

16. The chamber assembly of claim 1, wherein the ingress valve is positioned to reduce oscillation of a water level in the chamber during or after the water is evacuated from the chamber.

17. The chamber assembly of claim 1, further comprising a plenum, and exhaust valve, and a second sensor, wherein the second sensor is a temperature sensor configured to measure a temperature in the plenum, and wherein the control system is further configured to receive input from temperature sensor related to the measured temperature in the plenum.

18. The chamber assembly of claim 17, further comprising one or more fans blowing air into the plenum.

19. The chamber assembly of claim 18, further comprising a third sensor configured to measure an actual power consumption of the one or more fans.

20. The chamber assembly of claim 19, wherein the control system is transmit a signal to the exhaust valve, based on the measured power consumption, to adjust an exhaust valve angle to a desired exhaust valve angle.

* * * * *